US009024165B2

(12) United States Patent
Sharma

(10) Patent No.: US 9,024,165 B2
(45) **Date of Patent: *May 5, 2015**

(54) INVERTED KEYBOARD INSTRUMENT AND METHOD OF PLAYING THE SAME

(76) Inventor: Ravi Sharma, New York, NY (US)

( * ) Notice: Subject to any disclaimer, the term of this patent is extended or adjusted under 35 U.S.C. 154(b) by 35 days.

This patent is subject to a terminal disclaimer.

(21) Appl. No.: 13/066,588

(22) Filed: Apr. 18, 2011

(65) Prior Publication Data

US 2012/0180622 A1 Jul. 19, 2012

Related U.S. Application Data

(63) Continuation of application No. 10/528,164, filed as application No. PCT/US2004/024486 on Jul. 26, 2004, now Pat. No. 7,928,312.

(60) Provisional application No. 60/490,077, filed on Jul. 25, 2003.

(51) Int. Cl.
*G10C 3/12* (2006.01)
*G10H 1/34* (2006.01)

(52) U.S. Cl.
CPC ..... *G10H 1/34* (2013.01); *G10H 2220/221* (2013.01)
USPC ..... 84/423 R; 84/433; 84/477 R; 84/478

(58) Field of Classification Search
None
See application file for complete search history.

(56) References Cited

U.S. PATENT DOCUMENTS 3,419,668 A 12/1968 Sopriani ..... 84/1.17
3,419,688 A 12/1968 Sopriani ..... 84/1.17

(Continued)

OTHER PUBLICATIONS

Galocy, B, "Baran Galocy—Novation Innovator". http://www.aavak.com/interviews/baran.html on Oct. 20, 2003 (date of publication unknown): is directed to a split-keyboard MIDI controller.

(Continued)

*Primary Examiner* — Marlon Fletcher
(74) *Attorney, Agent, or Firm* — Pollack, P.C.

(57) ABSTRACT

An electronic keyboard instrument is provided and methods of playing and assembling the same. The instrument comprises a controller for enabling activation of electronic signals having audible, visible, amplifiable, recordable and/or like characteristics, and a power source for operating the controller. A first keyboard is provided having a first selected length and being oriented in a first direction such that (i) audible notes of music from at least one internal sound module and/or at least one external sound module, (ii) recordable data to be enhanced or modified by an external sequencer or program controlled apparatus, (iii) photoelectric signals, and (iv) processes or mechanisms, triggered or controlled by external signals or data, for controlling machines, video playback or lighting, and/or the like may be generated and/or activated using a first hand of one or more users. A second keyboard with a second selected length is generally coextensive with and oriented generally opposite to the first such that (i) audible notes of music from at least one internal sound module and/or at least one external sound module, (ii) recordable data to be enhanced or modified by an external sequencer or program controlled apparatus, (iii) photoelectric signals, and (iv) processes or mechanisms, triggered or controlled by external signals or data, for controlling machines, video playback or lighting, and/or the like may be generated and/or activated using a second hand of the one or more users. In addition, an interface connects the controller to at least one external device having sound module, and/or sequencing and signal enhancement functions. A plurality of peripheral devices operatively connected thereto permit interactive control and manipulation of the signals. Finally, a wearable support is mounted to the instrument for suspending the first and second keyboards from the user's body during instrument operation. Alternatively, the instrument is suspended by a support structure in a generally horizontal fashion for simultaneous operation by multiple users.

6 Claims, 13 Drawing Sheets

(56) References Cited

U.S. PATENT DOCUMENTS

| | | | | | |
|---|---|---|---|---|---|
| 3,617,600 | A | | 11/1971 | Ohno | 84/1.1 |
| 4,126,070 | A | | 11/1978 | Hill | 84/718 |
| 4,304,167 | A | * | 12/1981 | Tait | 84/429 |
| 4,594,931 | A | * | 6/1986 | Ishii | 84/609 |
| 4,635,519 | A | * | 1/1987 | Sakurai | 84/715 |
| 3,335,629 | A | | 8/1987 | Brodin | 84/1 |
| 5,262,580 | A | | 11/1993 | Tanaka et al. | 84/602 |
| 5,463,925 | A | | 11/1995 | Galocy | 84/423 |
| 5,507,215 | A | * | 4/1996 | Lin | 84/423 R |
| 5,557,057 | A | | 9/1996 | Starr | 84/617 |
| 5,744,740 | A | | 4/1998 | Mizuno | 84/615 |
| 5,841,052 | A | | 11/1998 | Stanton | 84/600 |
| 5,908,997 | A | | 6/1999 | Arnold et al. | 84/615 |
| 6,118,063 | A | | 9/2000 | Steinbuhler | 84/423 R |
| 6,365,820 | B1 | | 4/2002 | Kondo et al. | 84/685 |
| 6,376,759 | B1 | | 4/2002 | Suzuki | 84/615 |
| 6,501,011 | B2 | | 12/2002 | Wesley | 84/719 |
| 6,538,188 | B2 | | 3/2003 | Kondo | 84/477 R |
| 121,398 | A1 | | 7/2003 | Mutou | 84/423 R |
| 7,396,987 | B1 | * | 7/2008 | Tentindo | 84/423 R |
| 7,495,163 | B1 | * | 2/2009 | Goodrich | 84/423 R |
| 7,667,119 | B1 | * | 2/2010 | Schlapkohl | 84/424 |
| 7,928,312 | B2 | * | 4/2011 | Sharma | 84/719 |
| 2003/0121398 | A1 | | 7/2003 | Mutou | 64/423 R |
| 2009/0049980 | A1 | * | 2/2009 | Sharma | 84/719 |
| 2010/0024625 | A1 | * | 2/2010 | Schlapkohl | 84/423 R |
| 2012/0180622 | A1 | * | 7/2012 | Sharma | 84/744 |

OTHER PUBLICATIONS

"MIDI Communication", Physical Computing, Tisch School of the Arts, New York University, http://fargo.ito.nyu.edu/~tigoe/pcomp/midi.shtml, dated Jul. 7, 2003.

"MIDI Basics", pp. 1-31, publisher unknown, undated.

"MIDI Communication", Physical Computing, Tisch School of the Arts, New York University, http://fargo.itp.tsoa.nyu.edu/~tigoe/pcomp/midi.shtml, dated Jul. 7, 2003.

Galocy, B, "Baran Galocy—Novation Innovator", http://www.aavak.com/interviews/baran.html on Oct. 20, 2003 (date of publication unknown): is directed to a split-keyboard MIDI controller.

* cited by examiner

INVERTED KEYBOARD INSTRUMENT AND METHOD OF PLAYING THE SAME

This application is a Continuation of U.S. patent application Ser. No. 10/528,164, filed Mar. 14, 2004, now U.S. Pat. No. 7,928,312, which is the U.S. National Stage of International Patent Application No. PCT/US2004/024486, filed Jul. 26, 2004, which, in turn, is based on U.S. Provisional Application Ser. No. 60/490,077, filed Jul. 25, 2003, priority of which is claimed in each of the foregoing Applications and the disclosure of which, and of each of the foregoing Applications, is hereby incorporated by reference herein in its entirety.

FIELD OF THE DISCLOSURE

The present invention relates generally to hand operated instruments and, more particularly, to finger and/or hand controlled devices such as piano-style keyboards for music instruments and the like.

BACKGROUND OF THE DISCLOSURE

Since the advent of the music keyboard in the $14^{th}$ century, little about its basic structure has changed. The keyboard generally has remained long, relatively straight, and supported in a horizontal or near horizontal fashion to be played by one or both hands. Representative keyboard instruments have ranged from those that are played from a seated position such as the piano, harpsichord and modern synthesizer, to those typically played while a musician is standing, e.g., the melodica and accordion.

In perhaps its most common form, i.e., the classic piano design, the keyboard comprises a single, superimposed row of alternating black and white keys, e.g., eighty-eight (88) keys in total, the keys corresponding to consecutive octaves of music notes A through G major and minor, respectively. By classic piano design, such keyboards are typically supported in a horizontal fashion so that a musician may readily operate the same, either from a seated position in front of the keyboard or by standing or leaning over the keyboard. While this arrangement has long been used with relative success in playing and composing music, melodies that can be created and the expressiveness of the musician have generally been limited to what can physically be done from one of these two positions. Similarly, their relative size, shape and configuration have restricted the number of pianists that can practically fit in front of the keyboard and play the same.

According to various modern approaches, the classic piano type keyboard has been adapted to pneumatically driven and/or electronic pipe organs, electronic synthesizers and, most recently, the MIDI (or Musical Instrument Digital Interface) keyboard controller and hand-held synthesizer, and the wearable MIDI keyboard controller. Such controllers are commonly provided with piano style keys as well as switches, buttons, continuous type controllers (e.g., rotatable knobs and turn wheels), input/output connectors and a MIDI interface. The interface, for instance, comprises female 5-pin DIN connectors for signal IN, OUT or THRU-put. Alternatively, MIDI signals are adapted to flow in and out of controllers via USB (or Universal Serial Bus) connectors linked to computers or other USB cable-equipped devices. An advantage of USB connectors is that they allow signals to flow in both directions simultaneously via a single cable, while providing power to the controller in lieu of other power supplies.

The keys of such keyboards are typically equipped with electronic pressure sensors including NOTE ON, NOTE OFF, velocity and after-touch pressure. Typically, the MIDI controller either (i) has an internal sound module (e.g., a built-in synthesizer) for sound production, (ii) enables connection of the controller to external sound modules, other controllers, computer hardware and/or software for sequencing and sound enhancement, or (iii) has both internal and external arrangements for the same. Where an internal sound module is provided, in addition to standard MIDI connectors (for IN, OUT and THRU-put) or other MIDI connections, e.g., USB, output connectors are provided for output of audio signals, whereas the input connectors may be Used for audio input and/or output or other signal-related data. An objective is to allow connection of other external controllers such as foot pedals, breath-controllers and/or other ONOFF and/or continuous controllers for controlling output signals and/or data.

Like the piano, this keyboard arrangement is oriented horizontally such as on a stand or table. Alternatively, it is placed in a near horizontal orientation, e.g., strapped over the musician's shoulder like a guitar. In the horizontal orientation, the apparatus is played like a piano. In the near horizontal position, on the other hand, the musician plays the instrument with one hand while the other hand is free for operating the switches, buttons, knobs, etc.

Although workable for some applications, conventional MIDI keyboard controller arrangements allow the musician to play the keyboard with only one hand, the other hand being used merely to control various buttons or knobs for manipulating characteristics of sounds to be generated. Accordingly, not only does it restrict the complexity of music and accompaniment that can be played, but also the freedom and expressiveness with which one composes and performs music. Stated differently, the melodies that can be created and the expressiveness of the musician are limited to what physically can be done given the orientation, size and shape of the keyboard and its proximity to the user. Moreover, there is a physical limit on the number of musicians that may be involved in playing a single keyboard instrument.

A keyboard instrument is, therefore, desired that enables a musician to use both hands when playing, even when the keyboard is in a non-horizontal position but without placing either hand in an awkward position, so that the instrument may be worn and played with a new level of expression not previously achievable using a keyboard instrument.

OBJECTS AND SUMMARY OF THE DISCLOSURE

According to one aspect of disclosure, an electronic keyboard instrument is provided, which comprises a controller that enables activation of electronic signals having audible, visible, amplifiable, recordable and/or like characteristics, and a power source for operating the controller. A first keyboard is provided having a first selected length and oriented in a first direction such that (i) audible notes of music from at least one internal sound module and/or at least one external sound module, (ii) recordable data to be enhanced or modified by an external sequencer or program controlled apparatus, (iii) photoelectric signals, and (iv) processes or mechanisms, triggered or controlled by external signals or data for controlling machines, video playback or lighting, and/or the like, may be generated and/or activated using a first hand of a user. A second keyboard having a second selected length, and being generally coextensive with and oriented generally opposite to the first, enables (i) audible notes of music from at least one internal sound module and/or at least one external sound module, (ii) recordable data to be enhanced or modified by an external sequencer or program controlled apparatus, (iii) photoelectric signals, and (iv) processes or mechanisms, triggered or controlled by external signals or data, for controlling machines, video playback or lighting, and/or the like, to be generated and/or activated using a second hand of the user. Also provided is an interface for connecting the controller to at least one external device having sound module, and/or sequencing and signal enhancement functions. A plurality of peripheral devices associated with the controller, e.g., mounted to the controller and/or located externally and operatively connected thereto via interfaces, allow interactive control and manipulation of the signals. Finally, a wearable support mounted to the instrument enables the first and second keyboards to be suspended from the user's body during instrument operation.

In accordance with another aspect of the disclosure, an electronic keyboard instrument is provided comprising a controller that enables activation of electronic signals having audible, visible, amplifiable, recordable and/or like characteristics, and a power source for operating the controller. The instrument includes a first keyboard having a first selected length and oriented in a first direction such that (i) audible notes of music from at least one internal sound module and/or at least one external sound module, (ii) recordable data to be enhanced or modified by an external sequencer or program controlled apparatus, (iii) photoelectric signals, and (iv) processes or mechanisms, triggered or controlled by external signals or data, for controlling machines, video playback or lighting, and/or the like, may be generated and/or activated using at least one hand of a first user. A second keyboard with a second selected length is also provided. The second keyboard is generally coextensive with and oriented generally opposite to the first keyboard such that (i) audible notes of music from at least one internal sound module and/or at least one external sound module, (ii) recordable data to be enhanced or modified by an external sequencer or program controlled apparatus, (iii) photoelectric signals, and (iv) processes or mechanisms, triggered or controlled by external signals or data, for controlling machines, video playback or lighting, and/or the like, may be generated and/or activated using at least one hand of a second user. An interface connects the controller to at least external device having sound module, and/or sequencing and signal enhancement functions, and a plurality of peripheral devices associated with the controller allow interactive control and manipulation of the signals. Last, a support mounted to the instrument suspends the first and second keyboards in a generally horizontal position for operation of the instrument by at least the first and second users.

According to a further aspect of the disclosure, an electronic keyboard instrument is provided, such being defined by upper and lower surfaces arranged generally parallel to one another with corresponding opposing curvilinear edges, and side surfaces separating the upper and lower surfaces, the side surfaces having edges for sealing engagement with the curvilinear edges. The instrument includes a controller that enables activation of electronic signals having audible, visible, amplifiable, recordable and/or like characteristics, and a power source for operating the controller. Also provided is a first keyboard having a first selected length and being oriented in a first direction such that (i) audible notes of music from at least one internal sound module and/or at least one external sound module, (ii) recordable data to be enhanced or modified by an external sequencer or program controlled apparatus, (iii) photoelectric signals, and (iv) processes or mechanisms, triggered or controlled by external signals or data, for controlling machines, video playback or lighting, and/or the like, may be generated and/or activated using a first hand of a user. A second keyboard has a second selected length, and is generally coextensive with and oriented generally opposite to the first keyboard, such that (i) audible notes of music from at least one internal sound module and/or at least one external sound module, (ii) recordable data to be enhanced or modified by an external sequencer or program controlled apparatus, (iii) photoelectric signals, and (iv) processes or mechanisms, triggered or controlled by external signals or data, for controlling machines, video playback or lighting, and/or the like, may be generated and/or activated using a second hand of the user. An interface connects the controller to at least one external device having sound module, and/or sequencing and signal enhancement functions. In addition, a plurality of peripheral devices associated with the controller are provided for interactive control and manipulation of the signals. For example, the devices may be mounted to at least one of the upper and side surfaces of the instrument, at least one of the devices may be mounted to one of the side surfaces of the instrument, and/or at least one of the devices may be located on a lower surface of the instrument for ready operability by the user. Finally, a wearable support mounted to the instrument serves to suspend the first and second keyboards from the user's body during instrument operation.

According to yet a further aspect of the disclosure, an electronic keyboard instrument is provided, the instrument having a generally S-like shape. The instrument is also defined by upper and lower surfaces arranged generally parallel to one another with corresponding opposing curvilinear edges, and side surfaces separating the upper and lower surfaces, the side surfaces having edges for sealing engagement with the curvilinear edges. A controller is provided that enables activation of electronic signals having audible, visible, amplifiable, recordable and/or like characteristics, and a power source for operating the controller. In addition, a first arcuate keyboard is provided, such having a first selected length and oriented in a first position along a first portion of the S-like shape such that (i) audible notes of music from at least one internal sound module and/or at least one external sound module, (ii) recordable data to be enhanced or modified by an external sequencer or program controlled apparatus, (iii) photoelectric signals, and (iv) processes or mechanisms, triggered or controlled by external signals or data, for controlling machines, video playback or lighting, and/or the like, may be generated and/or activated using a first hand of a user. A second arcuate keyboard having a second selected length, being generally coextensive with the first keyboard and being oriented in a fashion generally opposite to that of the first, is located on a second portion of the S-like shape such that (i) audible notes of music from at least one internal sound module and/or at least one external sound module, (ii) recordable data to be enhanced or modified by an external sequencer or program controlled apparatus, (iii) photoelectric signals, and (iv) processes or mechanisms, triggered or controlled by external signals or data, for controlling machines, video playback or lighting, and/or the like, may be generated and/or activated using a second hand of the user. Additionally, an interface is provided for connecting the controller to at least one external device having sound module, and/or sequencing and signal enhancement functions. A plurality of peripheral devices associated with the controller enable interactive control and manipulation of the signals, at least one of the devices being located on one of the side surfaces for ready operability by the user. Moreover, a wearable support mounted to the instrument suspends the first and second keyboards from the user's body during instrument operation.

Still another aspect of the disclosure concerns an electronic keyboard instrument defined by upper and lower surfaces arranged generally parallel to one another with corresponding opposing curvilinear edges, and side surfaces separating the upper and lower surfaces. The side surfaces have edges for sealing engagement with the curvilinear edges. In addition, the instrument comprises a controller that enables activation of electronic signals having audible, visible, amplifiable, recordable and/or like characteristics. A power source is utilized for operating the controller, as well as an interface for connecting the controller to at least one external device having sound module, and/or sequencing and signal enhancement functions. A first arcuate keyboard is provided having a first selected length and oriented in a first position such that (i) audible notes of music from at least one internal sound module and/or at least one external sound module, (ii) recordable data to be enhanced or modified by an external sequencer or program controlled apparatus, (iii) photoelectric signals, and (iv) processes or mechanisms, triggered or controlled by external signals or data, for controlling machines, video playback or lighting, and/or the like, may be generated and/or activated using a first hand of a user. A second arcuate keyboard having a second selected length is also included, the second keyboard being generally coextensive with the first and oriented in a fashion generally opposite to that of the first such that (i) audible notes of music from at least one internal sound module and/or at least one external sound module, (ii) recordable data to be enhanced or modified by an external sequencer or program controlled apparatus, (iii) photoelectric signals, and (iv) processes or mechanisms, triggered or controlled by external signals or data, for controlling machines, video playback or lighting, and/or the like, may be generated and/or activated using a second hand of the user. Each of the first and second arcuate keyboards are characterized by keys of continuously varying length, the keys being generally longer at the respective keyboard ends and shorter at the respective keyboard center so as to define an arcuate shape and, thereby, enhance user operation. A plurality of peripheral devices associated with the controller of an instrument for synthesizing audible electronic signals, a sequencer, a program controlled apparatus, or other controllable device enable interactive control and manipulation of the signals. At least one of the devices is located on one of the side surfaces for ready operability by the user. A wearable support mounted to the instrument suspends the first and second keyboards from the user's body during instrument operation.

According to another aspect of the disclosure, there is provided a method of playing an electronic keyboard instrument. Initially, the instrument is suspended from a user's body by a wearable support, e.g., in a generally vertical orientation, in a generally horizontal orientation, and/or an orientations in between, for ready operation. A first keyboard of the instrument is then engaged using a first hand of the user, the first keyboard having a first selected length and being oriented in a first direction such that (i) audible notes of music from at least one internal sound modified and/or at least one external sound module, (ii) recordable data to be enhanced or modified by an external sequencer or program controlled apparatus, (iii) photoelectric signals, and (iv) processes or mechanisms, triggered or controlled by external signals or data, for controlling machines, video playback or lighting, and/or the like, may be generated and/or activated thereby. Next, or concurrently therewith, a second keyboard of the instrument is engaged using a second hand of the user. The second keyboard has a second selected length and is generally coextensive with and oriented generally opposite to the first such that (i) audible notes of music from at least one internal sound module and/or at least one external sound module, (ii) recordable data to be enhanced or modified by an external sequencer or program controlled apparatus, (iii) photoelectric signals, and (iv) processes or mechanisms, triggered or controlled by external signals or data, for controlling machines, video playback or lighting, and/or the like, may be generated and/or activated thereby. Last, at least one of a plurality of peripheral devices associated with a controller, for enabling activation of electronic signals having audible, visible, amplifiable, recordable and/or like characteristics, of an instrument for synthesizing the audible electronic signals, a sequencer, a program controlled apparatus, or other controllable device is manipulated, e.g., by one of the first and second hands, so as to interactively control and manipulate the signals to achieve a desired effect.

According to yet another aspect of the disclosure, a method is provided for playing an electronic keyboard instrument. The instrument is defined by upper and lower surfaces arranged generally parallel to one another with corresponding opposing curvilinear edges, and side surfaces separating the upper and lower surfaces. The side surfaces have edges for sealing engagement with the curvilinear edges. Initially, the instrument is located in a generally horizontal position in front of a first user along one side surface of the instrument, and in front of a second user along a second side surface of the instrument for ready operation by the first and second users. Next, a first keyboard of the instrument is engaged using at least one hand of a first user, the first keyboard having a first selected length and being oriented in a first direction such that (i) audible notes of music from at least one internal sound module and/or at least one external sound module, (ii) recordable data to be enhanced or modified by an external sequencer or program controlled apparatus, (iii) photoelectric signals, and (iv) processes or mechanisms, triggered or controlled by external signals or data, for controlling machines, video playback or lighting, and/or the like may be generated and/or activated thereby. A second keyboard of the instrument is then engaged, or concurrently engaged, using at least one hand of a second user. The keyboard has a second selected length and is generally coextensive with and oriented generally opposite to the first such that (i) audible notes of music from at least one internal sound module and/or at least one external sound module, (ii) recordable data to be enhanced or modified by an external sequencer or program controlled apparatus, (iii) photoelectric signals, and (iv) processes or mechanisms, triggered or controlled by external signals or data, for controlling machines, video playback or lighting, and/or the like, may be generated and/or activated thereby. Thereafter, at least one of a plurality of peripheral devices associated with a controller, for enabling activation of electronic signals having audible, visible, amplifiable, recordable and/or like characteristics, of an instrument for synthesizing the audible electronic Signals, a sequencer, a program controlled apparatus, or other controllable device is manipulated for interactive control and manipulation of the signals to achieve a desired effect.

In accordance with yet a further aspect of the disclosure is a floating key assembly for a keyboard instrument. The assembly comprises a key supported by and suspended over a first resilient member in proximity to one end of the key and a second resilient member adjacent to the other and opposite end of the key. A guide is provided for directing movement of the key toward and away from at least one of the resilient members while restricting movement of the key and resilient members in the lateral and longitudinal directions. At least one sensor associated with each end of the key is provided for detecting physical properties of the key. For instance, upon engagement of the one end of the key with a user's finger, the one end is directed toward the one sensor associated therewith and against a selected, opposing biasing force exerted by the first resilient member, whereas the other key end is directed away from the one sensor associated therewith and with a selected, opposing biasing force exerted by the second resilient member, so as to define a floating pivot point of the key assembly. Alternatively or concurrently, upon engagement of the one end of the key with a user's finger, the one end is directed toward the one sensor associated therewith and against a selected, opposing biasing force exerted by the first resilient member, and the other key end is directed toward the one sensor associated therewith and against a selected, opposing biasing force exerted by the second resilient member.

Another aspect of the disclosure concerns a method of assembling an electronic keyboard instrument. Initially, a structural member is provided for housing one or more selected devices for generating audible signals. A controller is mounted to the member, the controller being adapted for enabling activation of electronic signals having audible, visible, amplifiable, recordable and/or like characteristics. Also, a power source is joined to the instrument for operating the controller. Next, a first keyboard is mounted to the member. The first keyboard has a first selected length and is oriented in a first direction such that (i) audible notes of music from at least one internal sound module and/or at least one external sound module, (ii) recordable data to be enhanced or modified by an external sequencer or program controlled apparatus, (iii) photoelectric signals, and (iv) processes or mechanisms, triggered or controlled by external signals or data, for controlling machines, video playback or lighting, and/or the like, may be generated and/or activated using a first hand of a user. In addition, a second keyboard is mounted to the member. The second keyboard has a second selected length and is generally coextensive with and oriented generally opposite to the first such that (i) audible notes of music from at least one internal sound module and/or at least one external sound module, (ii) recordable data to be enhanced or modified by an external sequencer or program controlled apparatus, (iii) photoelectric signals, and (iv) processes or mechanisms, triggered or controlled by external signals or data, for controlling machines, video playback or lighting, and/or the like, may be generated and/or activated using a second hand of the user. An interface, operatively associated with the member, is provided for connecting the controller to at least one external device having sound module, and/or sequencing and signal enhancement functions. A plurality of peripheral devices is then associated with the controller for interactive control and manipulation of the signals. Finally, a wearable support is mounted to the instrument for suspending the first and second keyboards from the user's body during instrument operation. Optionally, and in addition, a floating key assembly is mounted to the instrument.

In one embodiment, the method comprises a step of mounting a floating key assembly to the instrument, the assembly comprising a key supported by and suspended over a first resilient member in proximity to one end of the key and a second resilient member adjacent to the other and opposite end of the key, a guide for directing movement of the key toward and away from at least one of the resilient members while restricting movement of the key and resilient members in the lateral and longitudinal directions; and at least one sensor associated with each end of the key for detecting physical properties of the key.

Alternatively or concurrently, the step of mounting a floating key assembly to the instrument is performed, the assembly comprising a key supported by and suspended over a first resilient member in proximity to one end of the key and a second resilient member adjacent to the other and opposite end of the key; a guide for directing movement of the key toward and away from at least one of the resilient members while restricting movement of the key and resilient members in the lateral and longitudinal directions; and at least one sensor associated with each end of the key for detecting physical properties of the key, whereupon engagement of the one end of the key with a user's finger, the one end is directed toward the one sensor associated therewith and against a selected, opposing biasing force exerted by the first resilient member, whereas the other key end is directed away from the one sensor associated therewith and with a selected, opposing biasing force exerted by the second resilient member, so as to define a floating pivot point of the key assembly.

Further in the alternative or concurrently therewith, the method comprises the step of mounting a floating key assembly to the instrument, the assembly comprising a key supported by and suspended over a first resilient member in proximity to one end of the key and a second resilient member adjacent to the other and opposite end of the key; a guide for directing movement of the key toward and away from at least one of the resilient members while restricting movement of the key and resilient members in the lateral and longitudinal directions; and at least one sensor associated with each end of the key for detecting physical properties of the key, whereupon engagement of the one end of the key with a user's finger, the one end is directed toward the one sensor associated therewith and against a selected, opposing biasing force exerted by the first resilient member, and the other key end is directed toward the one sensor associated therewith and against a selected, opposing biasing force exerted by the second resilient member.

According to a further aspect of the disclosure, there is provided a method of assembling an electronic keyboard instrument. First, a structural member is provided for housing one or more selected devices for generating audible signals. Second, a controller is mounted to the member for enabling activation of electronic signals having audible, visible, amplifiable, recordable and/or like characteristics, and a power source is joined to the instrument for operating the controller. Next, a first keyboard is mounted to the member. The first keyboard has a first selected length and is oriented in a first direction such that (i) audible notes of music from at least one internal sound module and/or at least one external sound module, (ii) recordable data to be enhanced or modified by an external sequencer or program controlled apparatus, (iii) photoelectric signals, and (iv) processes or mechanisms, triggered or controlled by external signals or data, for controlling machines, video playback or lighting, and/or the like, may be generated and/or activated using a first hand of a user. A second keyboard is then mounted to the member. The second keyboard has a second selected length and is generally coextensive with and oriented generally opposite to the first such that (i) audible notes of music from at least one internal sound module and/or at least one external sound module, (ii) recordable data to be enhanced or modified by an external sequencer or program controlled apparatus, (iii) photoelectric signals, and (iv) processes or mechanisms, triggered or controlled by external signals or data, for controlling machines, video playback or lighting, and/or the like, may be generated and/or activated using a second hand of the user. Thereafter, an interface, operatively associated with the member, is provided for connecting the controller to at least one external device having sound module, and/or sequencing and signal enhancement functions. A plurality of peripheral devices is, in turn, associated with the controller for interactive control and manipulation of the signals. Last, a support is mounted to the instrument for suspending the first and second keyboards in a generally horizontal position for operation of the instrument by at least the first and second users.

In accordance with yet another aspect of the disclosure, a method is provided for assembling an electronic keyboard instrument. The method comprises the steps of: (i) forming upper and lower surface members having opposing curvilinear edges; (ii) forming side surface members for sealing engagement with the curvilinear edges; (iii) arranging the upper and lower surface members such that they are generally parallel to one another and the opposing curvilinear edges correspond with one another; (iv) joining the side surface members to the upper and lower surface members so as to form a housing of the instrument; (v) mounting a controller to the housing for enabling activation of electronic signals having audible, visible, amplifiable, recordable and/or like characteristics; (vi) joining a power source to the instrument for operating the controller; (vii) mounting a first keyboard to the member, the first keyboard having a first selected length and being oriented in a first direction such that (a) audible notes of music from at least one internal sound module and/or at least one external sound module, (b) recordable data to be enhanced or modified by an external sequencer or program controlled apparatus, (c) photoelectric signals, and (d) processes or mechanisms, triggered or controlled by external signals or data, for controlling machines, video playback or lighting, and/or the like, may be generated and/or activated using a first hand of a user; (viii) mounting a second keyboard to the member, the second keyboard having a second selected length and being generally coextensive with and oriented generally opposite to the first such that (a) audible notes of music from at least one internal sound module and/or at least one external sound module, (b) recordable data to be enhanced or modified by an external sequencer or program controlled apparatus, (c) photoelectric signals, and (d) processes or Mechanisms, triggered or controlled by external signals or data, for controlling machines, video playback or lighting, and/or the like may be generated and/or activated using a second hand of the user; (ix) providing an interface, operatively associated with the housing, for connecting the controller to at least one external device having sound module, and/or sequencing and signal enhancement functions; (x) associating a plurality of peripheral devices with the controller for interactive control and manipulation of the signals, e.g., the devices being mounted to at least one of the upper and side surfaces of the instrument, at least one of the devices being mounted to one of the side surfaces, and/or at least one of the devices being located on a lower surface of the instrument for ready operability by the user; and (xi) mounting a wearable support to the instrument for suspending the first and second keyboards from the user's body during instrument operation.

According to still a further aspect of the disclosure is a method of assembling an electronic keyboard instrument having a generally S-like shape. Initially, upper and lower surface members having opposing curvilinear edges are formed. Second, side surface members having edges for sealing engagement with the curvilinear edges are formed. Third, the upper and lower surface members are arranged such that they are generally parallel to one another and the opposing curvilinear edges correspond to one another. The side surface members are then joined to the upper and lower surface members so as to form a housing of the instrument. Next, a controller is mounted to the housing, the controller enabling activation of electronic signals having audible, visible, amplifiable, recordable and/or like characteristics, and a power source is joined to the instrument for operating the controller. Thereafter, a first arcuate keyboard is mounted to the housing. The first keyboard has a first selected length and is oriented in a first position along a first portion of the S-like shape such that (i) audible notes of music from at least one internal sound module and/or at least one external sound module, (ii) recordable data to be enhanced or modified by an external sequencer or program controlled apparatus, (iii) photoelectric signals, and (iv) processes or mechanisms, triggered or controlled by external signals or data, for controlling machines, video playback or lighting, and/or the like, may be generated and/or activated using a first hand of a user. A second arcuate keyboard is also mounted to the housing. The second keyboard has a second selected length, is generally coextensive with and oriented in a fashion generally opposite to the first, and is located on a second portion of the S-like shape such that (i) audible notes of music from at least one internal sound module and/or at least one external sound module, (ii) recordable data to be enhanced or modified by an external sequencer or program controlled apparatus, (iii) photoelectric signals, and (iv) processes or mechanisms, triggered or controlled by external signals or data, for controlling machines, video playback or lighting, and/or the like, may be generated and/or activated using a second hand of the user. An interface, operatively associated with the housing, is, then provided for connecting the controller to at least one external device having sound module, and/or, sequencing and signal enhancement functions. A plurality of peripheral devices is associated with the controller for interactive control and manipulation of the signals, at least One of the devices being located on one of the side surfaces for ready operability by the user. Last, a wearable support is mounted to the instrument for suspending the first and second keyboards from the user's body during instrument operation.

In accordance with still another aspect of the disclosure, a method is provided for assembling an electronic keyboard instrument having a generally S-like shape. The method comprises the steps of: (i) forming upper and lower surface members having opposing curvilinear edges; (ii) forming side surface members having edges for sealing engagement with the curvilinear edges; (iii) arranging the upper and lower surface members such that they are generally parallel to one another and the opposing curvilinear edges correspond to one another; (iv) joining the side surface members to the upper and lower surface members so as to form a housing of the instrument; (v) mounting a controller to the housing for enabling activation of electronic signals having audible, visible, amplifiable, recordable and/or like characteristics; (vi) joining a power source to the instrument for operating the controller; (vii) mounting a first arcuate keyboard to the housing; the first keyboard having a first selected length and being oriented in a first position such that (a) audible notes of music from at least one internal sound module and/or at least one external sound module, (b) recordable data to be enhanced or modified by an external sequencer or program controlled apparatus, (c) photoelectric signals, and (d) processes or mechanisms, triggered or controlled by external signals or data, for controlling machines, video playback or lighting, and/or the like, may be generated and/or activated using a first hand of a user; (viii) mounting a second arcuate keyboard to the housing, the second keyboard having a second selected length and being generally coextensive with and oriented in a fashion generally opposite to the first such that (a) audible notes of music from at least one internal sound module and/or at least one external sound module, (b) recordable data to be enhanced or modified by an external sequencer or program controlled apparatus, (c) photoelectric signals, and (d) processes or mechanisms, triggered or controlled by external signals or data, for controlling machines, video playback or lighting, and/or the like, may be generated and/or activated using a second hand of the user, each of the first and second arcuate keyboards being characterized by keys of continuously varying length, the keys being generally longer at the respective keyboard ends and shorter at the respective keyboard center so as to define an arcuate shape and, thereby, enhance user operation; (ix) providing an interface, operatively associated with the housing, for connecting the controller to at least one external device having sound module, and/or sequencing and signal enhancement functions; (x) associating a plurality of peripheral devices with the controller for interactive control and manipulation of the signals, at least one of the devices being located on one of the side surfaces for ready operability by the user; and (xi) mounting a wearable support to the instrument for suspending the first and second keyboards from the user's body during instrument operation.

It is, therefore, an object of the disclosure to provide a wearable keyboard instrument that may readily be played with both of a musician's hands.

Another object of the present invention is to provide a novel keyboard design and method of playing the same.

A further object of the disclosure is to provide an electronic keyboard instrument that may be readily played with enhanced expressiveness while being worn by the user.

Yet another object of the present invention is to provide a keyboard instrument that may be played with a new level of expression not previously achievable using a keyboard instrument or the like.

Still another object of the disclosure is to provide a keyboard instrument that may be readily played by multiple users.

Yet a further object of the disclosure is to provide a wearable, ergonomic keyboard instrument that is specially contoured to the shape of a user's body.

Another object of the disclosure is to provide a wearable keyboard instrument that may be adjusted to be played by both hands of a user without placing the hands in an awkward position.

Still a further object of the disclosure is to provide a versatile, customizable keyboard instrument that may be worn and played in a near vertical or near horizontal position or, alternatively, mounted to a stand and played horizontally like a piano.

Yet another object of the disclosure is to provide a novel floating key assembly for a keyboard instrument that may be played by one or more users and from either side of the instrument, independently or simultaneously.

Still another object of the disclosure is to simultaneously maximize both automation and user control of an electronic keyboard instrument.

Another object of the disclosure is to advance artistic expression using an electronic keyboard instrument.

A further object of the disclosure is to create an advance in musical expression through the use of an electronic keyboard instrument or the like.

Yet a further object of the disclosure is to provide an improved method for assembling an electronic keyboard instrument.

An instrument according to the disclosure will now be further described by reference to the following drawings which are not intended to limit the accompanying claims.

BRIEF DESCRIPTION OF THE DRAWINGS

The same numerals are used throughout the figure drawings to designate similar elements. Still other objects and advantages of the disclosure will become apparent from the following description of the preferred embodiments.

DETAILED DESCRIPTION OF THE PREFERRED EMBODIMENTS

Figure 1A:
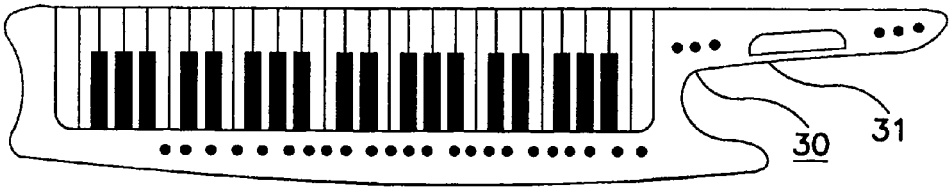
FIG. 1A is a plan view of the MIDI controller shown in FIG. 1.
Figure 1:
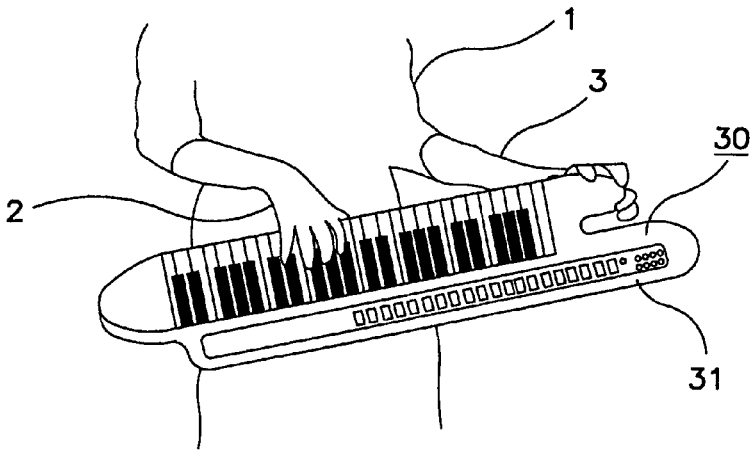
FIG. 1 is a perspective view of a conventional MIDI controller in operation by a user.

Referring now to the drawings and, more particularly, to FIGS. 1-14, there is shown generally a split or inverted keyboard instrument 10, preferably electronically based, having one or more keyboards 20, according to various aspects of the disclosure. According to one embodiment, the instrument includes a controller 30, e.g., a conventional MIDI controller unit 21 (shown generally in FIGS. 1 and 1A), for generating electronic signals to activate (or trigger) audible electronic signals or other signals having audible, visible (e.g., light or lighting), amplifiable (e.g., audio or power), recordable (e.g., digital data, MIDI messages and the like) and/or like characteristics, and a power source 40, such as a lithium based battery 41 or like DC power source, a USB computer cable 42 and/or a 120 volt, conventional household AC power source 43, for operating the controller.

A first keyboard 21 is provided having a first selected length 22 and oriented in a first direction 23 such that (i) audible notes of music from at least one internal sound module (not shown) and/or at least one external sound module (not shown), (ii) recordable data to be enhanced or modified by an external sequencer, such as of a conventional type, or a program controlled apparatus (e.g., conventional music industry computer with software for sound control and enhancement), (iii) photoelectric signals (such as conventional laser-based or infrared data transmission, light sensing activation or the like), and (iv) processes or mechanisms, triggered or controlled by external signals or data, for controlling machines, video playback or lighting, and/or the like, may be generated and/or activated using a first hand 2 of a user 1. A second keyboard 24 having a second selected length 25, and being generally coextensive with and orientted generally opposite to the first, also enables (i) audible notes of music from at least one internal sound module and/or at least one external sound module, (ii) recordable data to be enhanced or modified by an external sequencer or program controlled apparatus, (iii) photoelectric signals, and (iv) processes or mechanisms, triggered or controlled by external signals or data, for controlling machines, video playback or lighting, and/or the like to be generated and/or activated using a second hand 3 of the user.

Hence, MIDI and/or any other form of data that may be sent by (or received from) MIDI controller unit 31, e.g., so-called system exclusive messages, can be used not only to trigger sound modules and light mixers, but also any other apparatus set up to receive MIDI data messages. In this connection, conventional music industry tape decks, for example, are often equipped with MMC (or MIDI Machine Control) software 32 for sending and receiving MIDI messages 33 in order to perform functions 34 such as synchronized PLAY, REWIND, FAST FORWARD and STOP.

Also provided is an interface 50 for linking the controller to at least one external device 60 having sound module, and/or sequencing and signal enhancement functions 61. Conventional female standard 5-pin DIN connectors or USB connectors may be used. A USB connector has been found particularly well-suited for facilitating transfer of MIDI data between a music industry type computer and controllers/instruments. A plurality of peripheral devices 70 associated with the controller, e.g., mounted to the controller and/or located externally and operatively connected thereto via interfaces, allow interactive control and manipulation of the signals. Finally, a wearable support 80 mounted to the instrument enables the instrument, in general, and the first and second keyboards, in particular, to be suspended from the user's body during instrument operation.

Representative MIDI controllers, according to one aspect of the disclosure, and their operative components are shown, for example, in U.S. Pat. No. 5,744,740, issued on Apr. 28, 1998, entitled ELECTRONIC MUSICAL INSTRUMENT; U.S. Pat. No. 6,501,011 B2; issued Dec. 31, 2002, entitled SENSOR ARRAY MIDI CONTROLLER; and in U.S. Pat. No. 6,538,188 B2, issued Mar. 25, 2003, entitled ELECTRONIC MUSICAL INSTRUMENT WITH DISPLAY FUNCTION, the disclosures of which are hereby incorporated by reference in their entireties.

The foregoing descriptions are provided for purposes of illustration and not to limit the intended environment or application of the instrument according to the disclosure. The remaining structural and functional aspects of MIDI controllers are known by those skilled in the art and further description is considered unnecessary for illustration of the instrument.

Figure 2A:
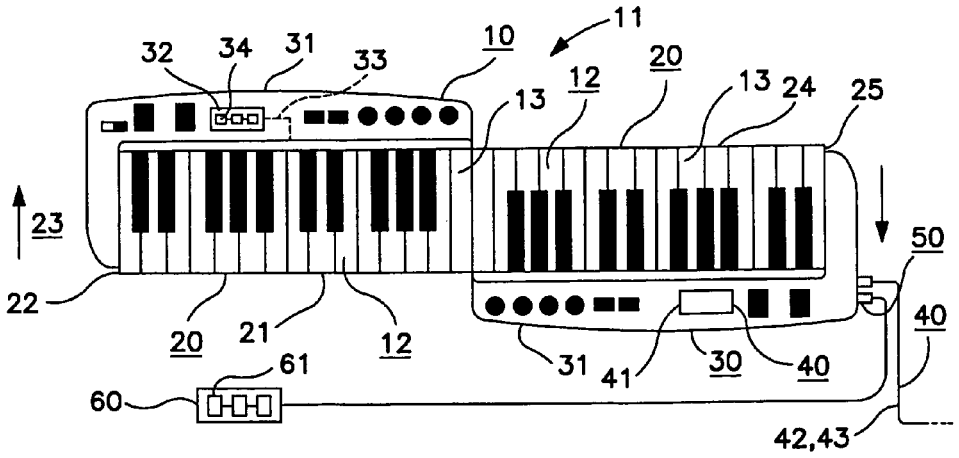
FIG. 2A is a plan view of the instrument shown in FIG. 2.
Figure 2:
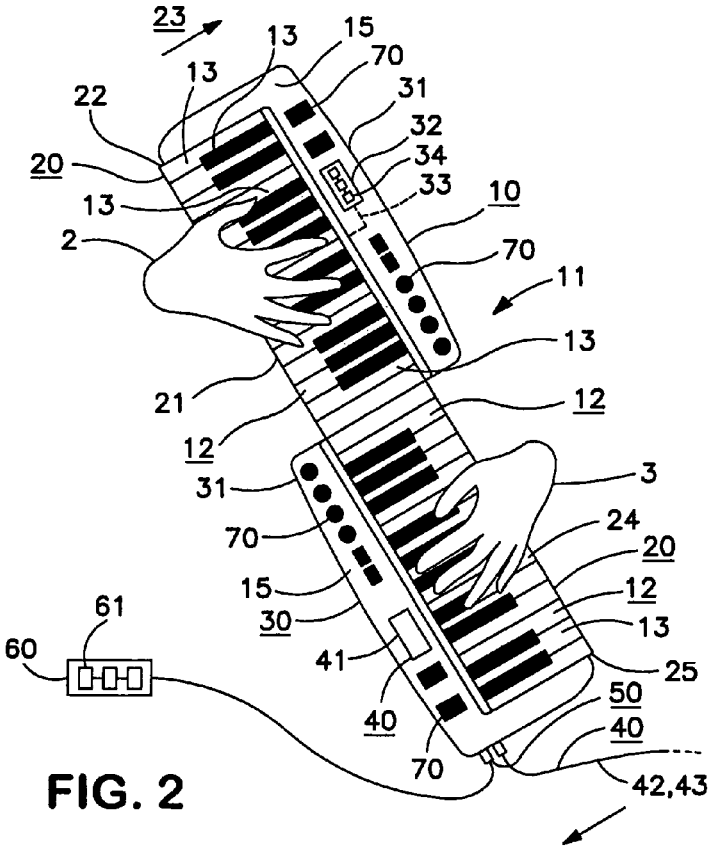
FIG. 2 is a perspective view of an electronic keyboard instrument, according to one embodiment of the disclosure.

In one embodiment, as shown in FIGS. 2 and 2A, the arrangement takes the form of a keyboard instrument 11 where a conventional keyboard that has been split and reversed at a midpoint or near midpoint so that the remaining keys are in the same general plane and on opposing sides of the keyboard. Desirably, keys 12 are played from the same direction, for instance, by pressing down on a top surface 13 thereof. As a result, rather than being strapped onto the user like a guitar or other conventional wearable keyboard instruments, i.e., with a strap worn over a shoulder of one arm, under the other arm, and connected to two ends of the instrument, the instrument of the disclosure is preferably adapted to be hung around the user's neck by the wearable support, e.g., a standard saxophone neck strap. This arrangement, in conjunction with the instrument's configuration, allows the user to hold and play the same such that each hand comfortably faces that portion of the keyboard that is oriented toward the hand, in a manner somewhat like that of holding and playing a saxophone.

Figure 3:
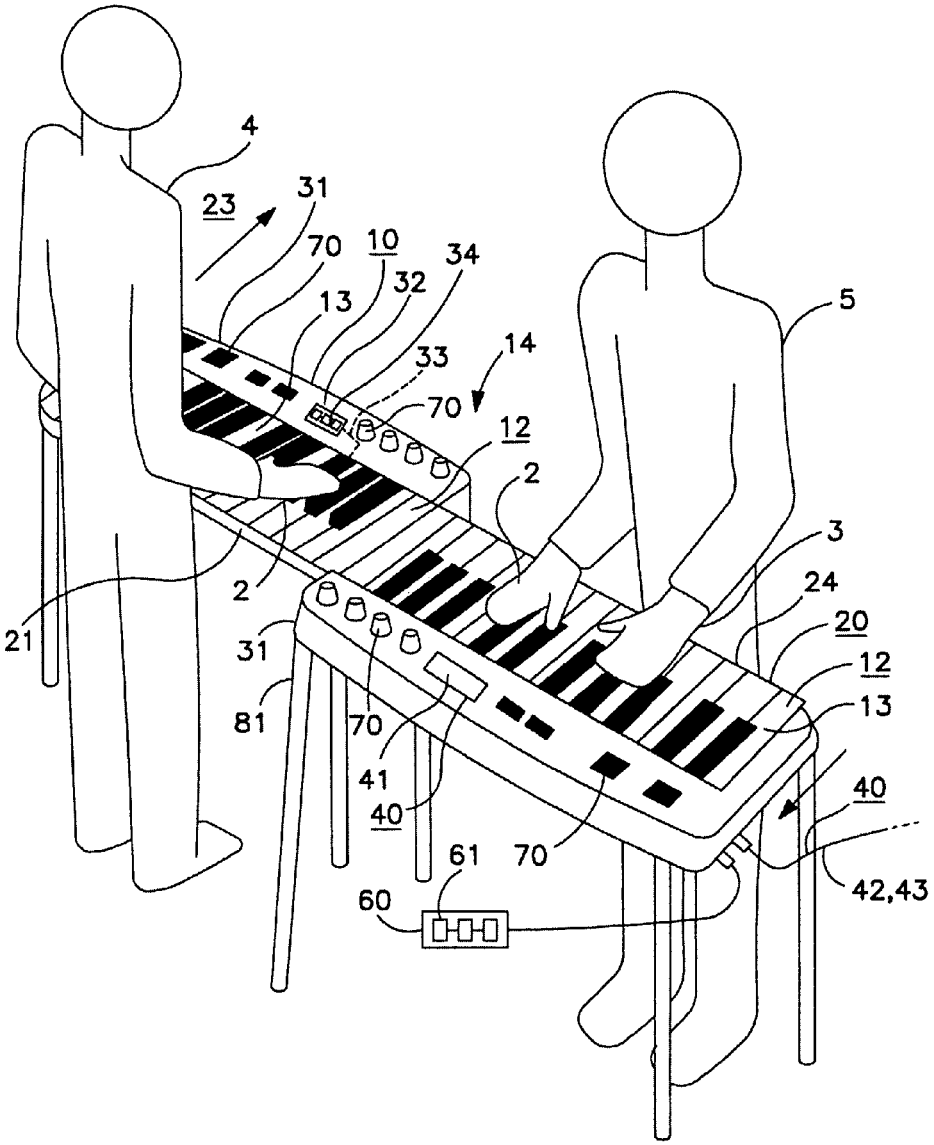
FIG. 3 is a perspective view of an electronic keyboard instrument in operation by multiple users, according to another embodiment of the disclosure.

Another embodiment of the disclosure is shown in FIG. 3. In this arrangement, a keyboard instrument 14 is provided that includes first keyboard 21 having first selected length 22 and oriented in first direction 23 such that (i) audible notes of music from at least one internal sound module and/or at least one external sound module, (ii) recordable data to be enhanced or modified by an external sequencer or program controlled apparatus, (iii) photoelectric signals, and (iv) processes or mechanisms, triggered or controlled by external signals or data, for controlling machines, video playback or lighting, and/or the like may be generated and/or activated using at least one hand of a first user. Second keyboard 24 with second selected length 25 is also provided. The second keyboard is generally coextensive with and oriented generally opposite to the first keyboard such that (i) audible notes of music from at least one internal sound module and/or at least one external sound module, (ii) recordable data to be enhanced or modified by an external sequencer or program controlled apparatus, (iii) photoelectric signals, and (iv) processes or mechanisms, triggered or controlled by external signals or data, for controlling machines, video playback or lighting, and/or the like, may be generated and/or activated using at least one hand of a second user. It is preferred that a support 81, e.g., a relatively flat table, a stand or other suitable support structure, mounted to the instrument suspends the first and second keyboards in a generally horizontal position for operation of the instrument by at least the first and second users 4, 5, respectively. Alternatively, the instrument is played from either side by one user 1 or from both sides by two or more users facing each other.

While the instrument, as shown, has a radically new appearance, the user or musician need not learn any new technique in order to play the same. More particularly, since the positioning of the user's hands in their playing position, according to the disclosure, is substantially the same as that required to play a standard, piano style keyboard, i.e., when played in the usual orientation where both hands are in front of the user and side-by-side when moving along a continuous keyboard of piano keys, e.g., eighty-eight. In a like manner, with the instrument of the disclosure, the user simply moves his or her right hand along the first keyboard in the direction of the little finger to sound higher frequency notes and in the direction of the thumb to sound lower frequency notes. This is identical to the technique used to play a standard piano style keyboard. The left hand of the user, in turn, moves along the second keyboard in the direction of the thumb to sound higher frequency notes, whereas the hand must move in the direction of the little finger to sound relatively lower frequency notes, also the same way as a standard keyboard.

Figure 4:
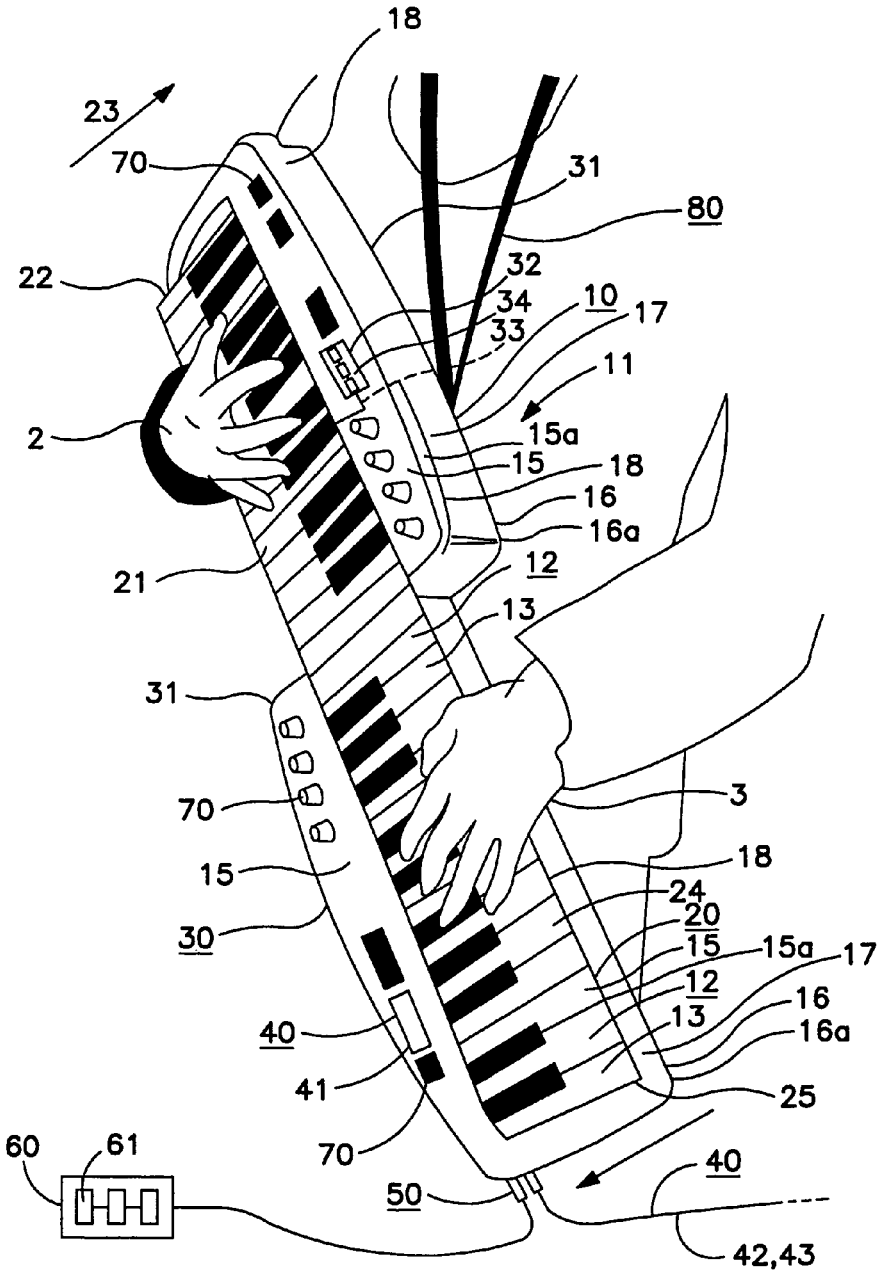
FIG. 4 is an alternative perspective view of the instrument illustrated in FIG. 2, suspended from the user's body in an operative position.

Hence, from the users perspective, he or she can play as normally as is done on a standard keyboard, but in a vastly more comfortable and more ergonomically correct way than has been permitted via the straps and positioning provided by conventional wearable MIDI controllers. Moreover, as shown in FIG. 4, the novel orientation, position and proximity to the user, afforded by the disclosure, allows the musician to "hug" the instrument and play, thereby, adding to the expressiveness of the interface, i.e., both between the user and instrument, and between the user and the music created.

Although the instrument has been shown and described in connection with an electronically based keyboard such as a MIDI controller or like synthesizer, its incorporation into Other keyboard-based devices, whether operated electronically, pneumatically or by some other power source, is understood, giving consideration to the purpose for which the instrument of the disclosure is intended.

In addition, while the instrument has been shown and described with reference to piano-style keyboards, as opposed to devices having a number of buttons and/or other resources for receiving the touch of a user's finger(s) or hand(s), application to other controller-type mechanisms having multiple buttons and/or other touch operated devices (not necessarily resembling piano keys) is understood to be within the spirit and scope of the disclosure. Such may include devices with activating switches to be pressed, moved or pressured, thermally sensing, and/or sensing motion of the user's finger(s), hand(s) or the like. In effect, an instrument, according to the disclosure, may be provided with all sliders, buttons, touch pads, etc., but no piano keys.

Figure 14:
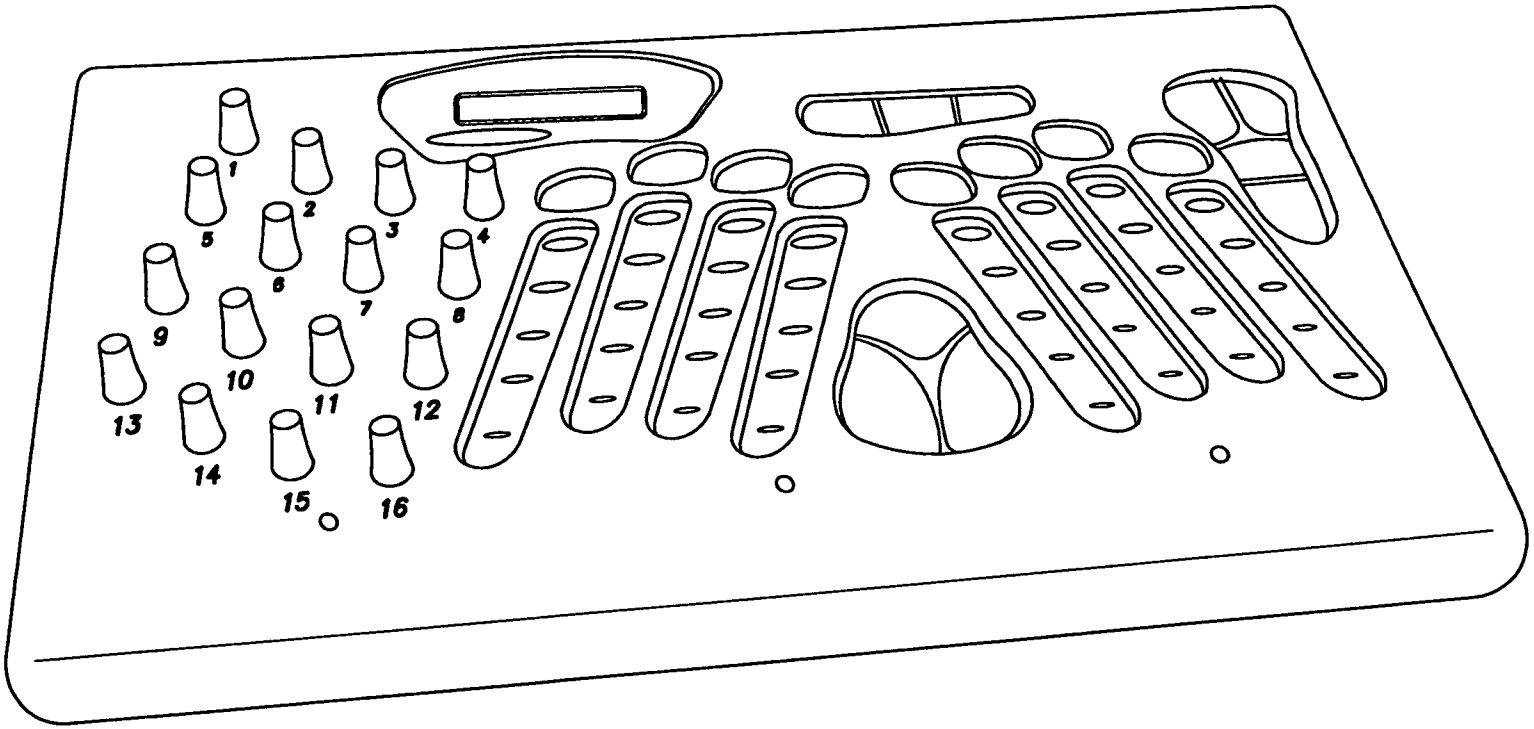
FIG. 14 is a perspective view of a MIDI controller, in accordance with a further aspect of the disclosure.

One suitable sensing device, according to the foregoing description, is set forth, for instance, in U.S. Pat. No. 6,501,011 B2, issued on Dec. 31, 2002. Another relates to a MIDI controller product with touch-strips, sold by M-Audio of Arcadia, Calif. As shown in FIG. 14, long, thin, pressure and area sensitive touch-strips are provided, one for each finger. Each strip may be tapped like a piano key so as to send data out, or operated by moving the fingers up and down the strip, or individually apply pressure thereto. According to one aspect of the disclosure, a plurality of such touch-strips are arranged in linear reverse formation, in a similar fashion to keys of the keyboard embodiments set forth above, and alternatively to or concurrently with such keyboard, within the spirit and scope of the this disclosure.

Figure 5:
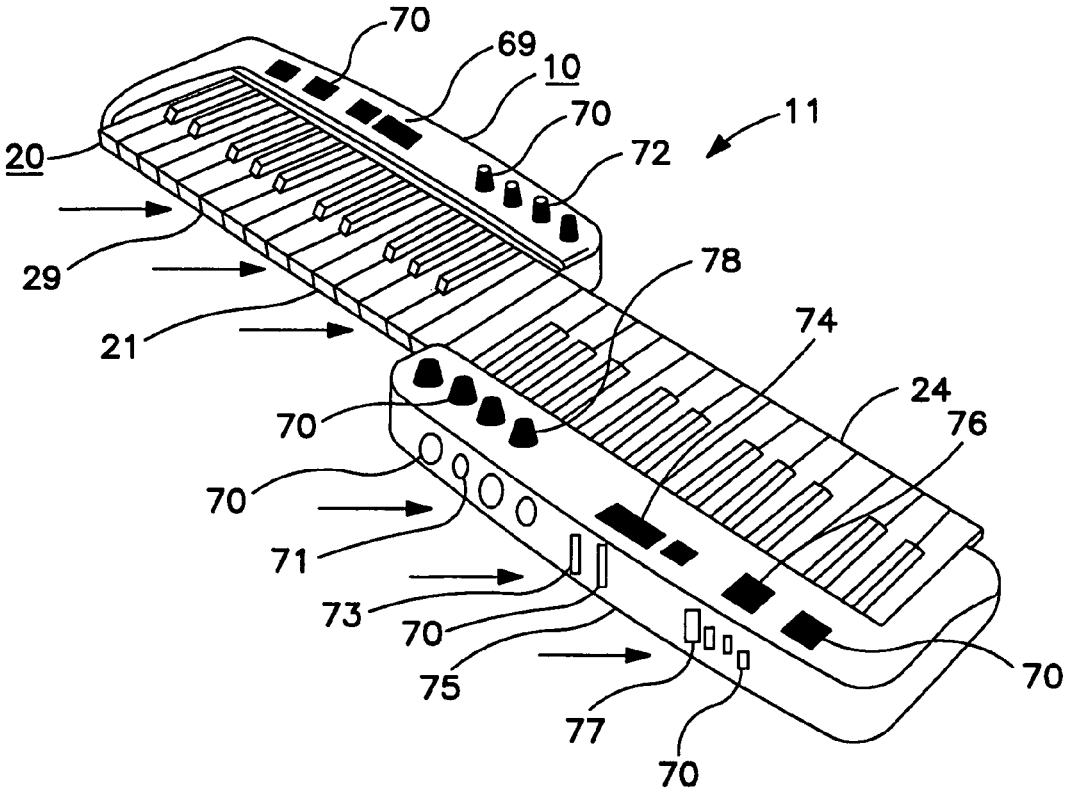
FIG. 5 is an alternative perspective view of the instrument of FIG. 2 showing preferred locations for control knobs, sliders, buttons, wheels, switches and displays, according to one aspect of the disclosure.

Generally speaking, the electronic keyboard instrument provided is preferably defined by upper and lower surfaces 15, 16, respectively, arranged generally parallel to one another with corresponding opposing curvilinear edges 15*a*, 16*a*, respectively, and side surfaces 17 separating the upper and lower surfaces. The side surfaces have edges 18 for sealing engagement with the curvilinear edges. In addition, as best seen in FIG. 5, at least one of the plurality of peripheral devices (associated with the controller for interactive control and manipulation of the signals), according to one embodiment, is mounted to one of the side surfaces for ready access and operability by the user. Alternatively or concurrently, the devices are mounted to both upper and side surfaces of the instrument. Further in the alternative or concurrently therewith, at least one of the devices is located on a lower surface of the instrument for like ease of access and operability.

Exemplary peripheral devices include, but are not limited to, buttons 71, knobs 72, sliders 73, wheels 74, ribbons 75, touch screens 76, pressure and/or area sensitive touchpads 77, joysticks 78, theremin-like devices 79 (i.e., electronic devices such as an electronic instrument played by moving hands near sensors designed to observe and react to the movement of objects nearby, and not necessarily in physical contact with the sensors, by any means, e.g., a product known as D-BEAM) and displays 69 (i) for sending data to an internal unit having sound generating circuitry, and/or via an interface, e.g., MIDI, to one or more external sound units having sound generating circuitry and, thereby, changing sounds on such internal or external interfaced units, sequencers, program controlled apparatus, and/or (ii) for sending and providing expressive information for various sound or program parameters such as pitch, vibrato, filter sweeps and the like to any such internal or external sound generating units, sequencers and/or program controlled apparatus. Frequently, as will be understood by those skilled in the art, the precise function of such buttons, knobs, sliders, wheels and displays are preprogrammed or optionally programmable by the user, whether from the external device or unit or from the controller itself. Desirably, external unit 60 may have similar buttons, knobs, sliders, wheels, ribbons, touch screens, pressure and/or area sensitive touchpads, joysticks theremin-like devices and displays, within the spirit and scope of the disclosure.

Overall, the instrument of the disclosure advantageously facilitates placement of the peripheral devices in such orientation relative to each inverted half of the instrument so as to be usable by or accessible to either hand. Additionally, such may be placed on sides 17 of the unit, either above and behind each of the first and second keyboards or under keys 12 themselves for ease of use by either hand of the user or users. In effect, since the unit is worn in the fashion shown and described above, placement of the buttons, knobs, sliders, wheels, ribbons, touch screens, pressure and/or area sensitive touchpads, joysticks, theremin-like devices and displays on the side surfaces allow's for easy line of sight and locations where a traditional keyboard (e.g., on a table or stand, or in "guitar strap" mode) would not permit such placement.

Figure 6:
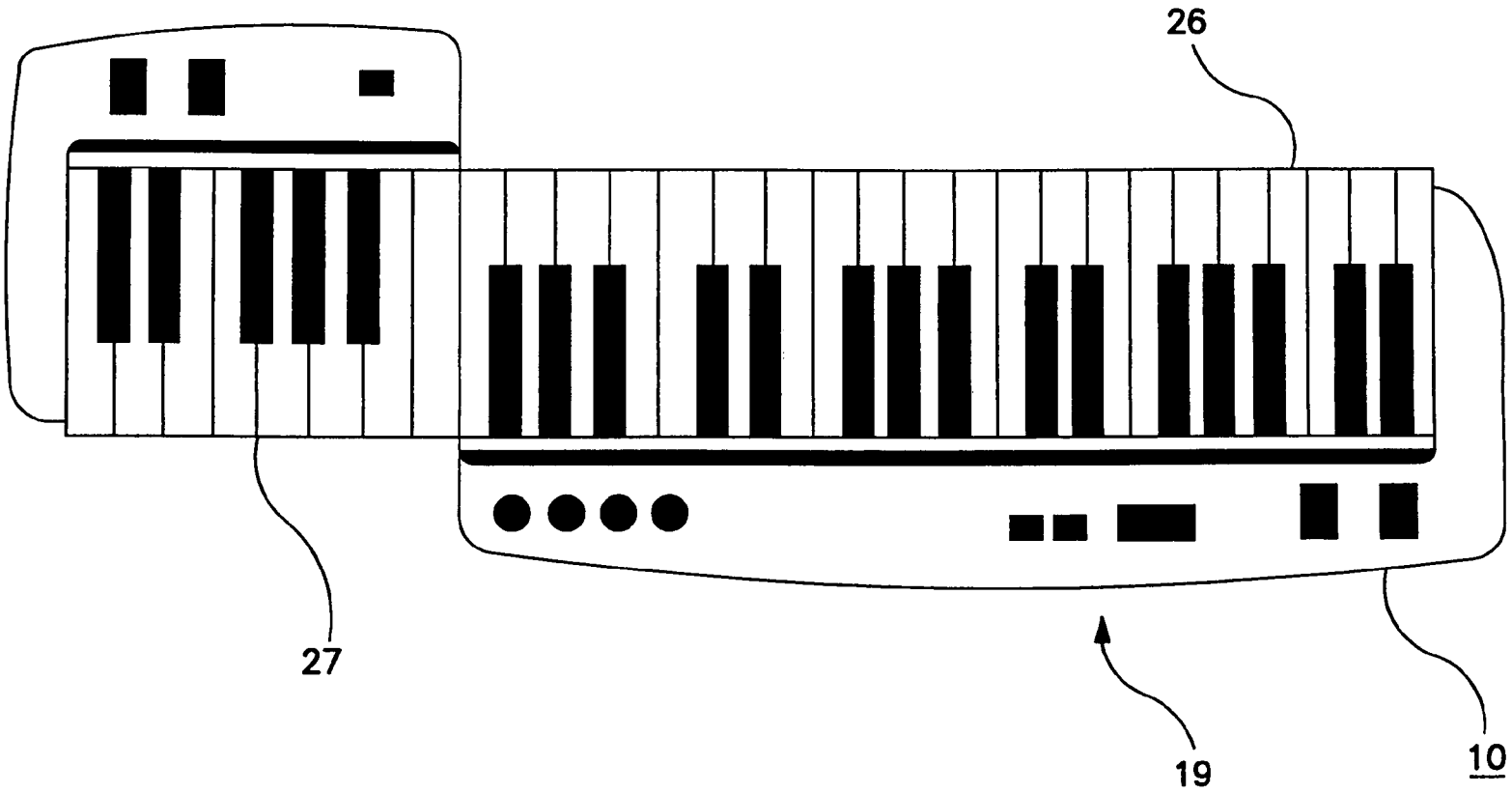
FIG. 6 is a plan view of an electronic keyboard instrument, in accordance with still another aspect of the disclosure.

Turning now to another aspect of the disclosure, as illustrated in FIG. 6, an instrument 19 is provided having its first keyboard 26 considerably longer than that of its second keyboard 27. In this connection, it is noted that the point where a standard piano style keyboard can be split into an inverted keyboard, as provided herein, is preferably done at a selected interval such as between octaves. Depending upon the physical construction of the instrument, in general, and the controller, in particular, the first and second keyboards may have 24 keys each, i.e., two octaves for each hand. Alternatively, the instrument can be maintained with differing numbers of keys for each hand. For instance, the first keyboard could have 48 keys and the second keyboard could have 16 keys. Accordingly, whether divided at octave intervals or not, the first and second keyboards need not have the same number of keys as one another.

Figure 7:
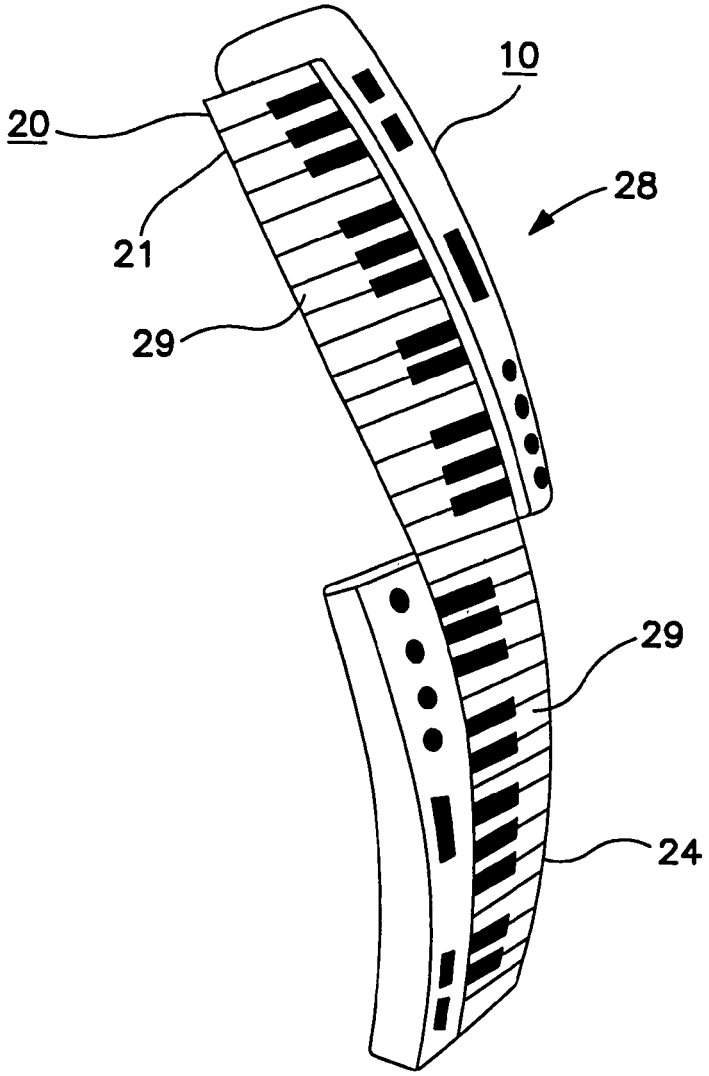
FIG. 7 is a perspective view of an ergonomic electronic keyboard instrument according to various aspects of the disclosure.
Figure 7A:
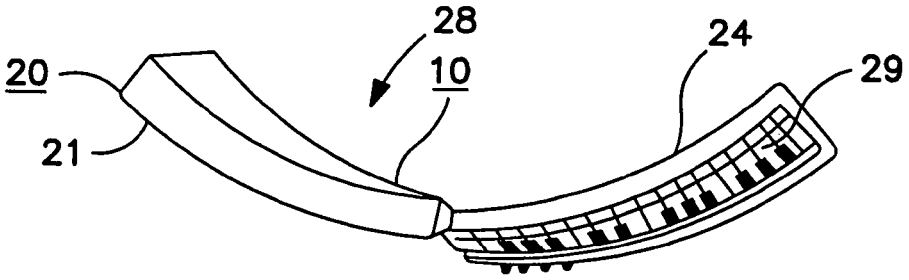
FIG. 7A is a reverse perspective view of the instrument shown in FIG. 7 showing body engaging portions thereof.
Figure 8:
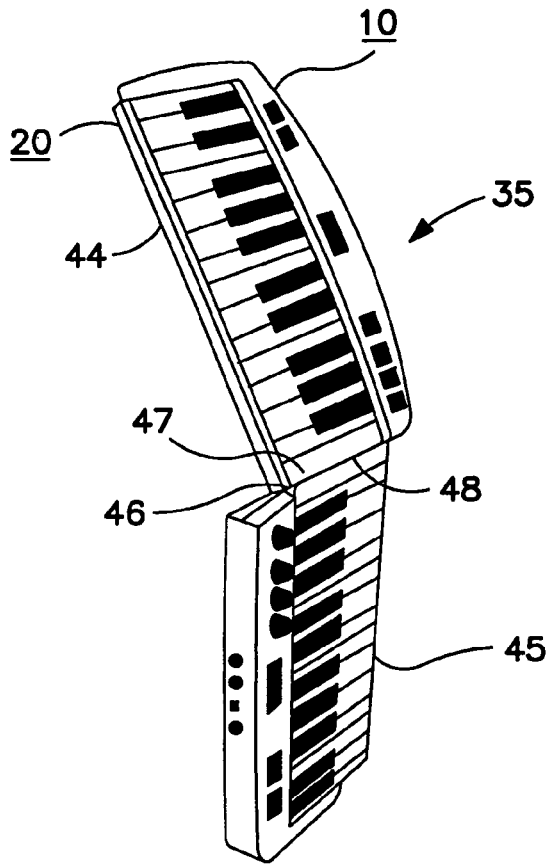
FIG. 8 is a perspective view of a customizable, pivotable ergonomic electronic keyboard instrument, in accordance with one aspect of the disclosure.
Figure 8A:
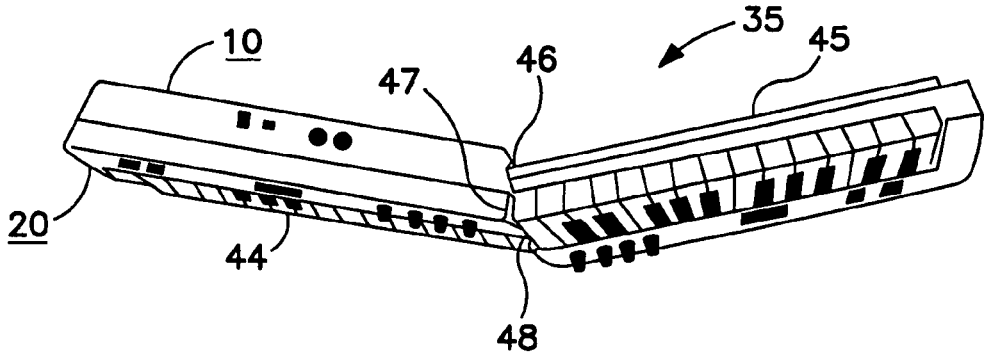
FIG. 8A is an alternative perspective view of the instrument shown in FIG. 8 showing operative portions and opposing side surfaces thereof.

Still a further embodiment of the disclosure provides an instrument 28 that is curved or bent so that keys 29 are more easily playable by each hand 2, 3 of user 1 and, in any case, in a particularly, ergonomically friendly fashion. This is desirably done at locations in proximity to the hip and shoulder of the user, and closer to the user's body, making it generally easier to play. An arrangement of this general description is shown, for instance, in FIGS. 7 and 7A. Alternatively, as illustrated in FIGS. 8 and 8A, an instrument 35 is provided having first and second keyboards 44, 45, respectively, separated from one another at a pivot point 46 or bend located midway between both ends 47 and 48 of the instrument or at another suitable point therebetween. This allows the keyboards to be positioned in a generally flat and straight manner, like a conventional piano style keyboard, without special construction requirements according to standard MIDI keyboard mechanisms.

The aforementioned ergonomically friendly arrangements have been found beneficial in that the user need not bend, strain or twist his/her hands and arms in less comfortable positions during operation of the instrument. As those skilled in the art will appreciate, a generally curved arrangement might require that a keyboard mechanism be manufactured specially to allow the actual key surface to curve along with the body of the keyboard.

Figure 9:
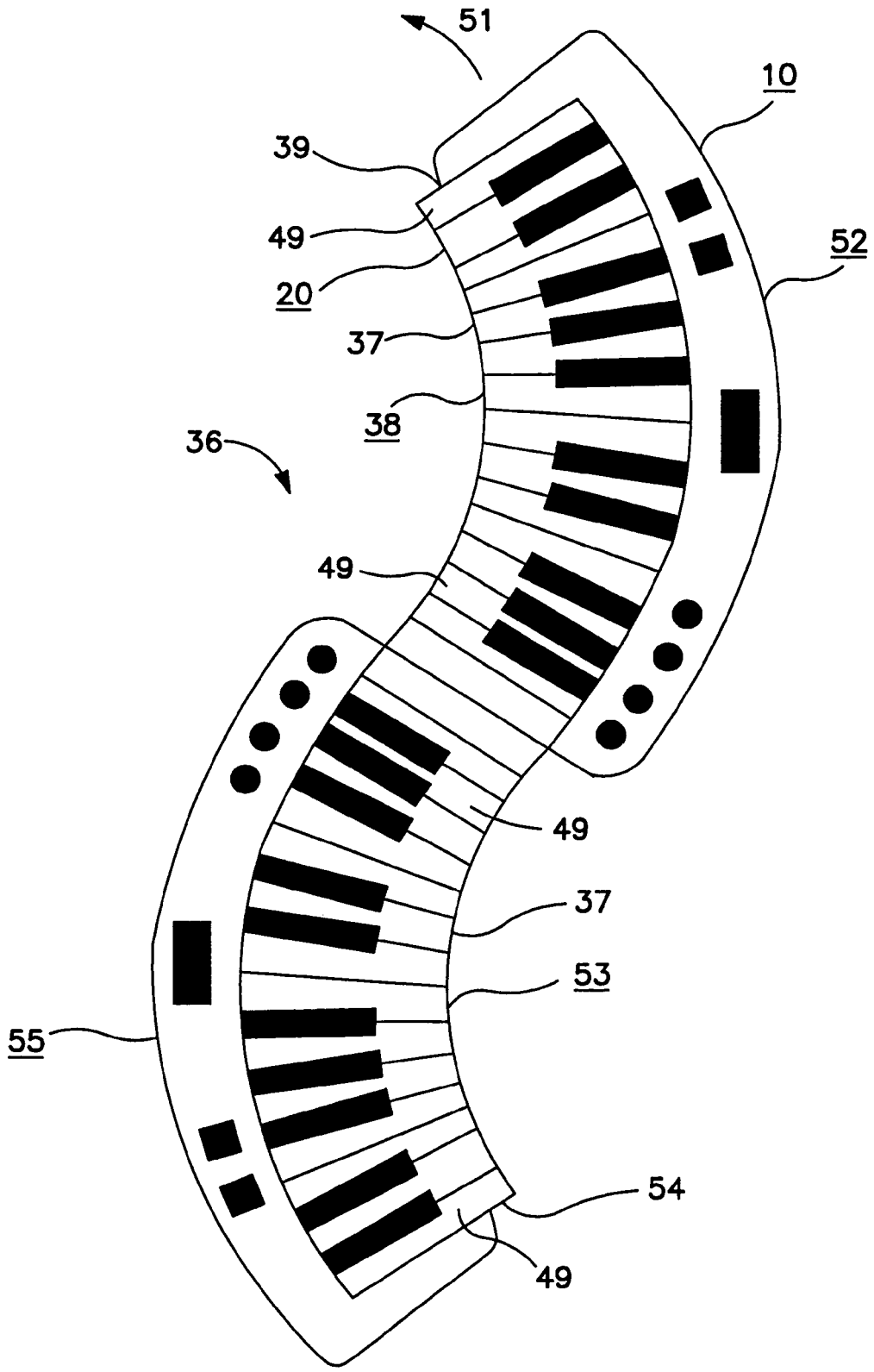
FIG. 9 is a plan view of an electronic keyboard instrument, according to yet another embodiment of the disclosure.

According to still another arrangement, as shown in FIG. 9, a keyboard instrument 36 is formed generally in the shape of an S or S-like such that each area of keys 49 to be played by each hand has a concavely curved row 37 of the keys. Specifically, a first arcuate keyboard 38 is provided, such having a first selected length 39 and oriented in a first position 51 along a first portion 52 of the S-like shape such that (i) audible notes of music from at least one internal sound module and/or at least one external sound module, (ii) recordable data to be enhanced or modified by an external sequencer or program controlled apparatus, (iii) photoelectric signals, and (iv) processes or mechanisms, triggered or controlled by external signals or data, for controlling machines, video playback or lighting, and/or the like, may be generated and/or activated using a first hand of a user. A second arcuate keyboard 53 having a second selected length 54, being generally coextensive with the first keyboard and being oriented in a fashion generally opposite to that of the first, is located on a second portion 55 of the S-like shape such that (i) audible notes of music from at least one internal sound module and/or at least one external sound module, (ii) recordable data to be enhanced or modified by an external sequencer or program controlled apparatus, (iii) photoelectric signals, and (iv) processes or mechanisms, triggered or controlled by external signals or data, for controlling machines, video playback or lighting, and/or the like, may be generated and/or activated using second hand 3 of the user.

Thus, according to this configuration, the hand moves from side-to-side while playing, as the forearm pivots at the elbow. To insure pivotal movement of the forearm about the elbow during use, the keys are positioned arcuately so that hand movement will follow the line of circumference created thereby.

This has been found especially advantageous in that the user's hand can more easily reach and play the keys, without straining the hands at the extreme top and bottom areas of the keyboards, that are active in playing. Notably, an S curve construction requires that a new keyboard mechanism be manufactured to accommodate the curvilinear arrangement required.

Alternatively or concurrently, and in order to operatively accommodate arcuate arrangeMerits as set forth herein, keys 49 may suitably take the form of an elongated trapezoid (rather than elongated rectangle) or have a flower pedal-like shape in that one end of the key is narrower than the other.

Figure 10:
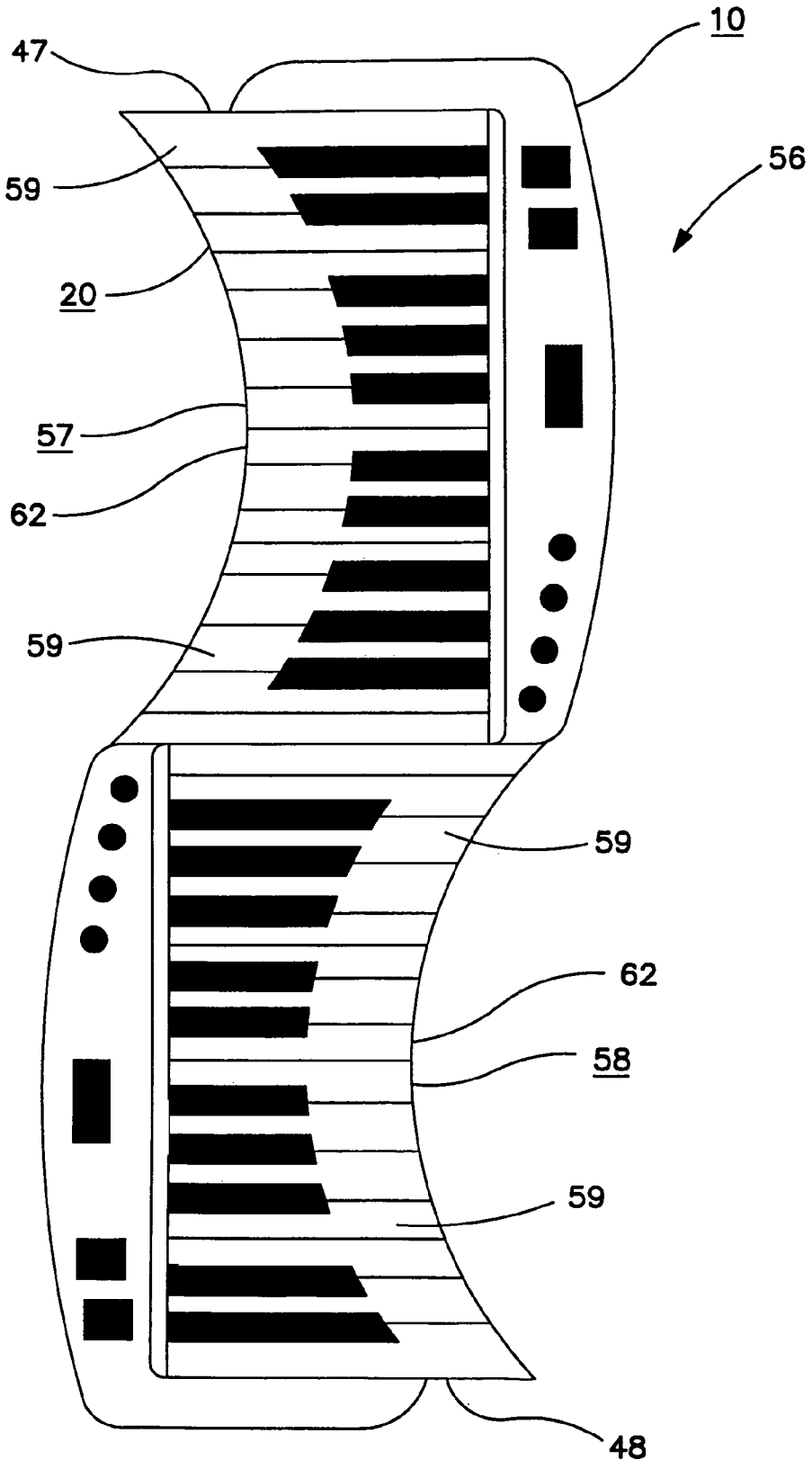
FIG. 10 is a plan view of an electronic keyboard instrument, in accordance with still a further embodiment of the disclosure.

Referring now to FIG. 10, an instrument 56 according to the disclosure is formed in the shape of a "faux" curve. In one embodiment, each of first and second arcuate keyboards 57, 58, respectively, are characterized by keys 59 of continuously varying length, the keys being generally longer at the respective keyboard ends 47, 48 and shorter at respective keyboard center 62 so as to define an arcuate shape and, thereby, enhance user operation. Specifically, this configuration is achieved by utilizing keys of progressively longer lengths toward the higher and lower edges of the key areas and then sectioning those key edges facing the hands in a concave fashion. And it allows for a standard piano style keyboard assembly, while presenting each hand with a concave playing surface that is more amenable to playing.

While the instrument has been shown and described with reference to MIDI controllers and the like, such is provided for purposes of illustration and not to limit the intended environment or application of the disclosure. As for those structural and functional aspects of MIDI controllers and their components that are not illustrated, such are known by those skilled in the art, and further description is considered unnecessary for purposes of illustrating the instrument. Notably, in the future, as MIDI controllers and interfaces may rely upon forms of operation and connection, respectively, other than what has been set forth herein, e.g., connectors for wireless transmission rather than USB connectors and forms of operation not yet developed, such are likewise considered to be within the scope and spirit of the disclosure.

According to various applications of the instrument, it is noted that data generated by MIDI controllers is highly versatile. MIDI data, in general, can be fed into almost any device that can accept such data and translate it into something else. MIDI controllers may, in turn, be used to control virtually any electronic signal including, but not limited to, sound, light, power, or like photoelectric and/or electromagnetic energy transmission. These controllers are particularly well-suited for controlling data from internal or external sound engines and for feeding data into computers for recording. For instance, a MIDI controller can be used to automate lighting changes for light mixing boards (such as those used in large theaters and at music shows) which generate MIDI data to be recorded and played back. In this manner, such controllers may be used to automate light changes via MIDI data synced to a music track, i.e., a single MIDI program may be used to change messages that might signal an external device such as a synthesizer 63 to change its sound to something else, while simultaneously causing a light mixer to change to a different preprogrammed combination of lights, etc. It is for these applications that the instrument according to the disclosure is considered particularly well-suited. Such a wearable controller for these uses and others, even if not necessarily having piano-style keys, is considered to embody the desirable qualities of the instrument.

Figure 11:
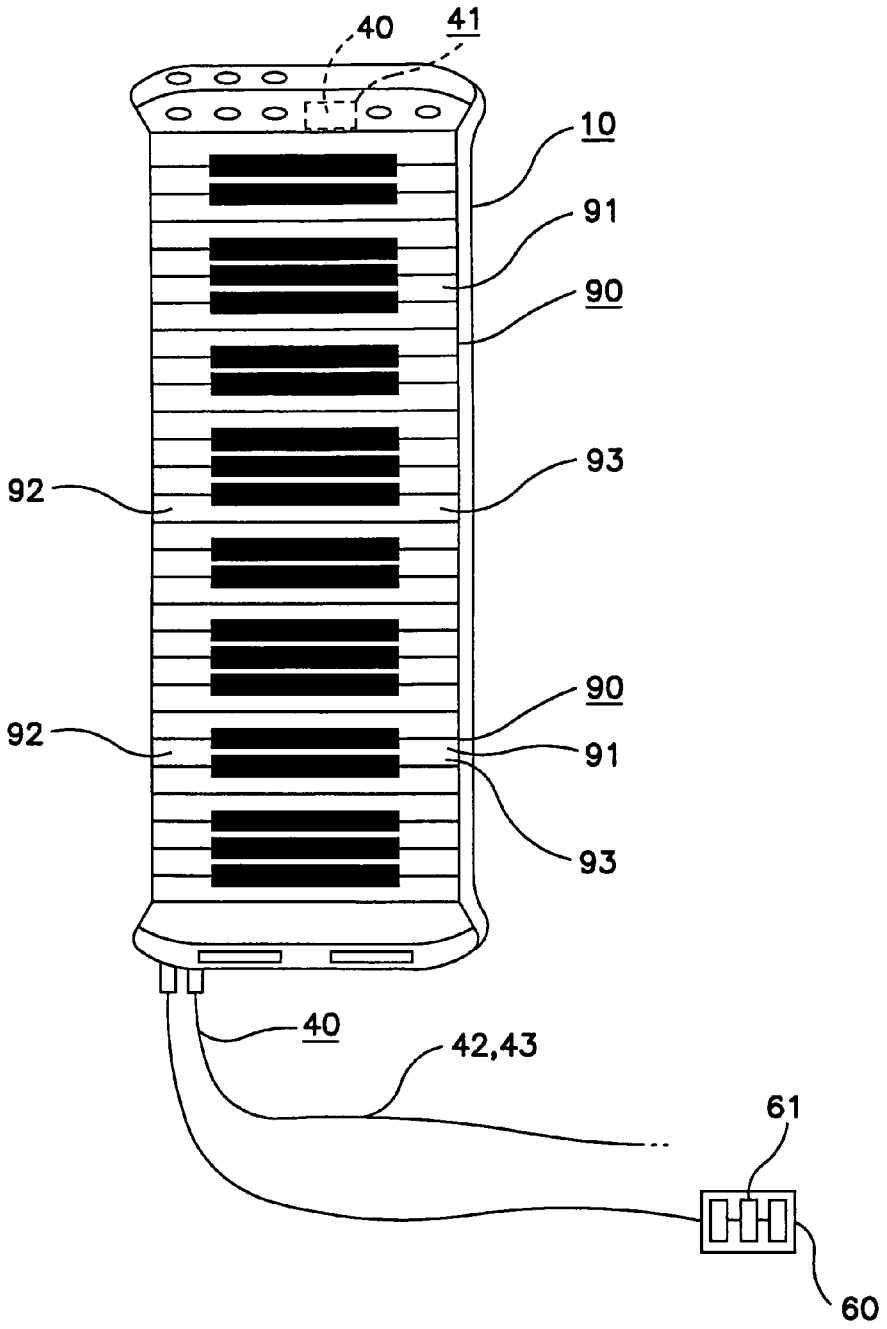
FIG. 11 is a plan view of an electronic keyboard instrument, according to yet a further aspect of the disclosure, incorporating floating key assemblies.
Figure 12:
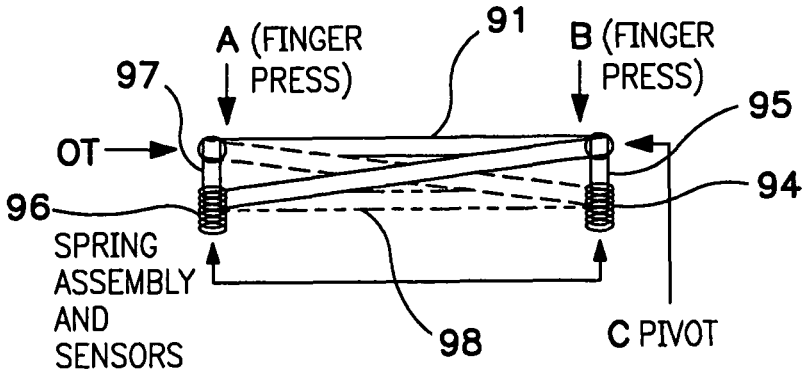
FIG. 12 is a diagrammatic representation of a floating key assembly and of the range of Motion of the assembly upon engagement of one end of the assembly, or both ends, with a user's finger.
Figure 13:
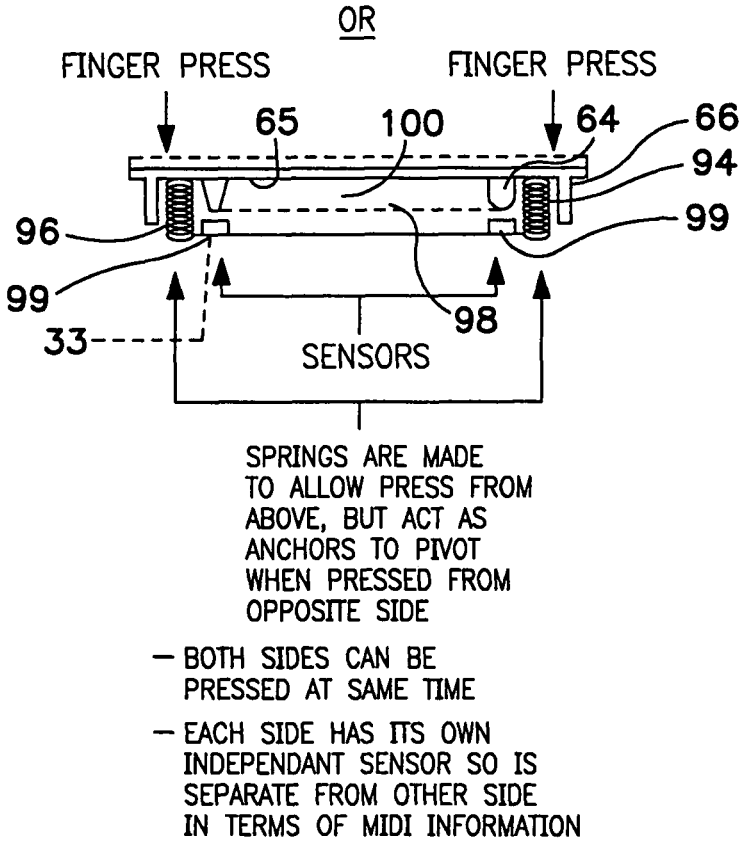
FIG. 13 is a diagrammatic representation of the floating key assembly of FIG. 12, according to another embodiment of the disclosure.

In accordance with yet a further aspect of the disclosure is a floating key assembly 90 for a keyboard instrument, as shown in FIGS. 11-13. Rather than utilizing keys inverted at a specific point, the instrument is desirably provided with an opposing, double cantilever type, key 91 arrangement that allows each key to be approachable and playable from either side 92 or 93, i.e., from either hand while the instrument is worn by one user or by more than one user or from either side when the keyboard is in a flat horizontal or table position.

Specifically, the assembly comprises key 91 supported by and suspended over a first resilient member 94, such as a conventional coil or leaf-type spring, in proximity to one end 95 of the key and a second resilient member 96, e.g., another conventional spring preferably of like tension, adjacent to the other and opposite end 97 of the key. A guide 98 is provided for directing movement of the key toward and away from at least one of the resilient members while restricting movement of the key and resilient members in the lateral and longitudinal directions. At least one sensor 99 associated with each end of the key is provided for detecting physical properties of the key, such as velocity, acceleration of motion, and/or approach of the user's finger.

It is preferred that one of the sensors at one end of the key be independent from one at the other key end so that MIDI information or messages 33 from each sensor is provided separately and independently. Also, a tooth-like, spring engaging member 64 is desirably provided at least one end 66 of each key, such protruding from selected underside portions 65 thereof, for insuring a relatively consistent pathway of up and down key movement and for aiding in the suspension or "floating" of the key over the springs.

In one embodiment, upon engagement of the one end of the key with the user's finger, such end is directed toward the sensor associated therewith and against a selected, opposing biasing force exerted by first resilient member 94. More or less concurrently, the other keyend is directed away from the sensor associated with such other key end, being aided generally in this motion by a selected, opposing biasing force exerted by second resilient member 96. The relative directing of the one key end toward the sensor and the other key end away from the sensor defines a floating pivot point 100 of the key assembly.

Alternatively, upon engagement of the one key end with the user's finger, that end is again directed toward the sensor associated therewith and against the selected, opposing biasing force exerted by the first resilient member. The other key end, on the other hand, is directed toward the sensor associated with such other key end, such motion being hindered by or against the selected, opposing biasing force exerted by the second resilient member.

While the foregoing embodiments of the assembly allow each key to be played from either side, such sends different and independent data depending upon the side from which it is played—there being two oppositely positioned sets of sensors per key for NOTE ON, NOTE OFF, velocity, acceleration, after-touch pressure and/or any other type of data that can be generated by differing methods of manipulating a key on a keyboard, e.g., moving the keys slightly from side-to-side or the like. In addition, keyboards incorporating such floating key assemblies operate essentially the same as those keys above that are activated from one side only in wearing the instrument and playing the same. However, an added advantage is that a more compact instrument is provided. Specifically, because by one MIDI controller arrangement, there are 36 such keys (3 octaves), each hand then has access to three octaves but without the need for 72 keys. Also, given the compact construction and that each key is playable from either side, surfaces available for locating peripheral devices—i.e., buttons, knobs, sliders, wheels, ribbons, touch screens, pressure and/or area sensitive touchpads, joysticks, theremin-like devices, displays and/or the like—above the keys and on the same plane are limited, so that their location beside the keys on the same plane, and below the keys, are more suitable. Such locations for placement of these devices are considered particularly desirable as a clear line of sight is provided, and superior tactile and access for the hands to press, rotate or otherwise operate such devices under the keys while the instrument is worn.

In operation, the instrument is first suspended from a user's body by a wearable support in a generally vertical orientation for ready operation. A first keyboard of the instrument is then engaged using a first hand of the user, the first keyboard having a first selected length and being oriented in a first direction such that (i) audible notes of music from at least one internal sound module and/or at least one external sound module, (ii) recordable data to be enhanced or modified by an external sequencer or program controlled apparatus, (iii) photoelectric signals, and (iv) processes or mechanisms, triggered or controlled by external signals or data, for controlling machines, video playback or lighting, and/or the like may be generated and/or activated thereby. Next, or concurrently therewith, a second keyboard of the instrument is engaged using a second hand of the user. The second keyboard has a second selected length and is generally coextensive with and oriented generally opposite to the first such that (i) audible notes of music from at least one internal sound module and/or at least one external sound module, (ii) recordable data to be enhanced or modified by an external sequencer or program controlled apparatus, (iii) photoelectric signals, and (iv) processes or mechanisms, triggered or controlled by external signals or data, for controlling machines, video playback or lighting, and/or the like may be generated and/or activated thereby. Last, at least one of a plurality of peripheral devices associated with a controller of the instrument for synthesizing the audible electronic signals, is manipulated by one of the first and second hands, so as to interactively control and manipulate the signals to achieve a desired effect.

Alternatively, the instrument is initially suspended from the user's body in a generally horizontal orientation for ready operation. The first keyboard of the instrument is engaged using a first hand of the user, and the second keyboard of the instrument is engaged by the user's second hand. Further in the alternative, the instrument is first located in a generally horizontal position in front of a first user along one side surface of the instrument, and in front of a second user along a second side surface of the instrument for ready operation by the first and second users. Next, a first keyboard of the instrument is engaged using at least one hand of a first user, and a second keyboard of the instrument is engaged, using at least one hand of a second user. Thereafter, at least one of a plurality of peripheral devices associated with a controller of the instrument, e.g., again mounted to the controller and/or located externally and operatively connected thereto via interfaces, is manipulated for interactive control and manipulation of the signals to achieve a desired effect.

Referring now to another aspect of the disclosure, a method is provided for assembling an electronic keyboard instrument. Initially, a structural member is provided for housing one or more selected devices for generating audible signals. A controller is mounted to the member, the controller being adapted for enabling activation of electronic signals having audible, visible, amplifiable, recordable and/or like characteristics. Also, a power source is joined to the instrument for operating the controller. Next, a first keyboard is mounted to the member. The first keyboard has a first selected length and is oriented in a first direction such that (i) audible notes of music from at least one internal sound module and/or at least one external Sound module, (ii) recordable data to be enhanced or modified by an external sequencer or program controlled apparatus, (iii) photoelectric signals, and (iv) processes or mechanisms, triggered or controlled by external signals or data, for controlling machines, video playback or lighting, and/or the like, may be generated and/or activated using a first hand of a user. In addition, a second keyboard is mounted to the member. The second keyboard has a second selected length and is generally coextensive with and oriented generally opposite to the first such that (i) audible notes of music from at least one internal sound module and/or at least one external sound module, (ii) recordable data to be enhanced or modified by an external sequencer or program controlled apparatus, (iii) photoelectric signals, and (iv) processes or mechanisms, triggered or controlled by external signals or data, for controlling machines, video playback or lighting, and/or the like, may be generated and/or activated using a second hand of the user. An interface, operatively associated with the member, connects the controller to at least one external device having sound module, and/or sequencing and signal enhancement functions. A plurality of peripheral devices is then associated with the controller for interactive control and manipulation of the signals. Finally, a wearable support is mounted to the instrument for suspending the first and second keyboards from the user's body during instrument operation.

Alternatively, a support is mounted to the instrument for suspending the first and second keyboards in a generally horizontal position for operation of the instrument by at least the first and second users. Optionally, at least one of the peripheral devices is mounted to one of the side surfaces for ready operability by the user. Alternatively or concurrently, the one or more devices are mounted to at least one of the upper and side surfaces of the instrument for ready operability by the user. According to another arrangement, at least one of the devices is located on a lower surface of the instrument for ready operability by the user. Optionally, and in addition, a floating key assembly is mounted to the instrument.

According to still a further aspect of the disclosure is a method of assembling an electronic keyboard instrument having a generally S-like shape. Initially, upper and lower surface members having opposing curvilinear edges, and side surface members having edges for sealing engagement with the curvilinear edges, are formed. The upper and lower surface members are arranged such that they are generally parallel to one another and the opposing curvilinear edges correspond to one another. The side surface members are then joined to the upper and lower surface members so as to form a housing of the instrument. A controller is mounted to the housing, the controller enabling activation of electronic signals having audible, visible, amplifiable, recordable and/or like characteristics, and a power source is joined to the instrument for operating the controller.

Next, a first arcuate keyboard is mounted to the housing. The first keyboard has a first selected length and is oriented in a first position along a first portion of the S-like shape such that (i) audible notes of music from at least one internal sound module and/or at least one external sound module, (ii) recordable data to be enhanced or modified by an external sequencer or program controlled apparatus, (iii) photoelectric signals, and (iv) processes or mechanisms, triggered or controlled by external signals or data, for controlling machines, video playback or lighting, and/or the like, may be generated and/or activated using a first hand of a user.

A second arcuate keyboard is also mounted to the housing. The second keyboard has a second selected length, is generally coextensive with and oriented in a fashion generally opposite to the first, and is located on a second portion of the S-like shape such that (i) audible notes of music from at least one internal sound module and/or at least one external sound module, (ii) recordable data to be enhanced or modified by an external sequencer or program controlled apparatus; (iii) photoelectric signals, and (iv) processes or mechanisms, triggered or controlled by external signals or data, for controlling machines, video playback or lighting, and/or the like, may be generated and/or activated using a second hand of the user.

An interface, operatively associated with the housing, is then provided for connecting the controller to at least one external device having sound module, and/or sequencing and signal enhancement functions. A plurality of peripheral devices is associated with the controller for interactive control and manipulation of the signals, at least one of the devices being located on one of the side surfaces for ready operability by the user. Last, a wearable support is mounted to the instrument for suspending the first and second keyboards from the user's body during instrument operation.

Alternatively or concurrently, each of the first and second arcuate keyboards is characterized by keys of continuously varying length, the keys being generally longer at the respective keyboard ends and shorter at the respective keyboard center so as to define an arcuate shape and, thereby, enhance user operation; at least one of the devices being located on one of the side surfaces for ready operability by the user. Optionally, and in addition, a floating key assembly is also utilized.

Various modifications and alterations may be appreciated based on a review of this disclosure. These changes and additions are intended to be within the scope aril spirit of the disclosure as defined by the following claims.

What is claimed is:

1. An electronic keyboard instrument comprising:

a controller for enabling activation of electronic signals having one or more of audible, visible, amplifiable or recordable characteristics;

a power source for operating the controller;

a first keyboard having a first selected length and oriented in a first direction such that (i) audible notes of music from at least one internal sound module or at least one external sound module, or audible notes of music from at least one internal sound module and at least one external sound module, (ii) recordable data to be enhanced or modified by an external sequencer or program controlled apparatus, (iii) photoelectric signals, and (iv) processes or mechanisms, triggered or controlled by external signals or data, for controlling machines, video playback or lighting, may be generated or activated using a first hand of a user;

a second keyboard having a second selected length, the second keyboard being generally coextensive with and oriented generally opposite to the first such that (i) audible notes of music from at least one internal sound module or at least one external sound module, or audible notes of music from at least one internal sound module and at least one external sound module, (ii) recordable data to be enhanced or modified by an external sequencer or program controlled apparatus, (iii) photoelectric signals, and (iv) processes or mechanisms, triggered or controlled by external signals or data, for controlling machines, video playback or lighting, may be generated or activated using a second hand of the user;

each of the first and second keyboards being characterized by keys of continuously varying length, the keys being substantially longer at the respective keyboard ends and substantially shorter at the respective keyboard center so as to define an arcuate shape and, thereby, enhance user operation;

an interface for connecting the controller to at least one external device having sound module, or sequencing and signal enhancement functions, or sound module, and sequencing and signal enhancement functions;

a plurality of peripheral devices associated with the controller for interactive control and manipulation of the signals; and a support strap mounted to the instrument for variable suspension of the first and second keyboards from the user's body during instrument operation.

2. The instrument set forth in claim 1, wherein at least one of the peripheral devices is mounted to one of the side surfaces for ready operability by the user.

3. The instrument set forth in claim 1 wherein the peripheral devices include at least one of an adjustable knob, adjustable slider, a button, wheel or switch.

4. The instrument set forth in claim 1 wherein the peripheral devices include at least one of a display, touch screen, or a pressure or area sensitive touchpad.

5. The instrument set forth in claim 1 wherein the peripheral devices include at least one of a theremin-like device, a ribbon controller or a joystick.

6. An electronic keyboard instrument defined by upper and lower surfaces arranged generally parallel to one another with corresponding opposing curvilinear edges, and side surfaces separating the upper and lower surfaces, the side surfaces having edges for sealing engagement with the curvilinear edges, the instrument comprising:

a controller for enabling activation of electronic signals having one or more of audible, visible, amplifiable or recordable characteristics;

a power source for operating the controller;

a first keyboard having a first selected length and oriented in a first direction such that (i) audible notes of music from at least one internal sound module or at least one external sound module, or audible notes of music from at least one internal sound module and at least one external sound module, (ii) recordable data to be enhanced or modified by an external sequencer or program controlled apparatus, (iii) photoelectric signals, and (iv) processes or mechanisms, triggered or controlled by external signals or data, for controlling machines, video playback or lighting, may be generated or activated using a first hand of a user;

a second keyboard having a second selected length, the second keyboard being generally coextensive with and oriented generally opposite to the first such that (i) audible notes of music from at least one internal sound module or at least one external sound module, or audible notes of music from at least one internal sound module and at least one external sound module, (ii) recordable data to be enhanced or modified by an external sequencer or program controlled apparatus, (iii) photoelectric signals, and (iv) processes or mechanisms, triggered or controlled by external signals or data, for controlling machines, video playback or lighting, may be generated or activated using a second hand of the user;

each of the first and second keyboards being characterized by keys of continuously varying length, the keys being substantially longer at the respective keyboard ends and substantially shorter at the respective keyboard center so as to define an arcuate shape and, thereby, enhance user operation;

an interface for connecting the controller to at least one external device having sound module, and/or sequencing and signal enhancement functions;

a plurality of peripheral devices associated with the controller for interactive control and manipulation of the signals; and a support strap mounted to the instrument for variable suspension of the first and second keyboards from the user's body during instrument operation.

* * * * *